US008199171B2

(12) United States Patent
Inoue et al.

(10) Patent No.: US 8,199,171 B2
(45) Date of Patent: Jun. 12, 2012

(54) DISPLAY DEVICE, IMAGE SIGNAL PROCESSING METHOD, AND PROGRAM

(75) Inventors: Yasuo Inoue, Tokyo (JP); Toshihide Hayashi, Kanagawa (JP); Masayuki Tsumura, Tokyo (JP); Koki Tsumori, Tokyo (JP); Katsuhiro Shimizu, Tokyo (JP); Ban Kawamura, Tokyo (JP); Ryuichi Okumura, Kanagawa (JP)

(73) Assignee: Sony Corporation, Tokyo (JP)

( * ) Notice: Subject to any disclaimer, the term of this patent is extended or adjusted under 35 U.S.C. 154(b) by 777 days.

(21) Appl. No.: 12/270,931

(22) Filed: Nov. 14, 2008

(65) Prior Publication Data

US 2009/0135304 A1 May 28, 2009

(30) Foreign Application Priority Data

Nov. 16, 2007 (JP) ..... P2007-298618

(51) Int. Cl.
*G09G 5/10* (2006.01)

(52) U.S. Cl. ..... 345/690; 345/77; 345/82; 345/204

(58) Field of Classification Search ..... 345/76, 345/77, 82, 83, 204, 690, 691; 250/552, 250/553; 315/169.3
See application file for complete search history.

(56) References Cited

U.S. PATENT DOCUMENTS

| | | | | |
|---|---|---|---|---|
| 7,742,019 | B2 * | 6/2010 | Takahara | 345/76 |
| 7,796,143 | B2 * | 9/2010 | Huang | 345/690 |
| 2007/0103408 | A1 | 5/2007 | Tada et al. | |
| 2007/0115302 | A1 | 5/2007 | Huang | |
| 2008/0042953 | A1 * | 2/2008 | De Haan et al. | 345/89 |

FOREIGN PATENT DOCUMENTS

| | | |
|---|---|---|
| EP | 1 727 119 | 11/2006 |
| EP | 1 995 952 | 11/2008 |
| WO | WO 2006 040722 | 4/2006 |
| WO | WO 2007 102413 | 9/2007 |

* cited by examiner

*Primary Examiner* — Lun-Yi Lao
*Assistant Examiner* — Tom Sheng
(74) *Attorney, Agent, or Firm* — Frommer Lawrence & Haug LLP; William S. Frommer; Thomas F. Presson

(57) ABSTRACT

There is provided a display device equipped with a display unit, the display device including a receiving part for receiving a difference signal of a plurality of channels including an image signal and content identification information inserted in a blanking period and outputting the image signal and the content identification information; a light emission amount regulation part for setting a reference duty according to image information of the image signal; an adjustment part for adjusting so that an actual duty is within a predetermined range based on the reference duty and an adjustment signal and adjusting a gain of the image signal so that a light emission amount defined by the actual duty and the gain of the image signal becomes the same as the light emission amount defined by the reference duty; and an adjustment signal generation part for generating the adjustment signal based on the content identification information.

14 Claims, 18 Drawing Sheets

FIG.7

| | | | | | | | | |
|---|---|---|---|---|---|---|---|---|
| InfoFrame Type Code | InfoFrame Type Ⅲ$02_{16}$ | | | | | | | |
| InfoFrame Version Number | Version Ⅲ$02_{16}$ | | | | | | | |
| Length of AVI InfoFrame | Length of AVI InfoFrame (13) | | | | | | | |
| Data Byte 1 | Rsvd(0) | Y1 | Y0 | A0 | B1 | B0 | S1 | S0 |
| Data Byte 2 | C1 | C0 | M1 | M0 | R3 | R2 | R1 | R0 |
| Data Byte 3 | ITC | EC2 | EC1 | EC0 | Q1 | Q0 | SC1 | SC0 |
| Data Byte 4 | Rsvd(0) | VIC6 | VIC5 | VIC4 | VIC3 | VIC2 | VIC1 | VIC0 |
| Data Byte 5 | CT1 | CT0 | Rsvd(0) | Rsvd(0) | PR3 | PR2 | PR1 | PR0 |
| Data Byte 6,7 | Line Number of End of Top Bar | | | | | | | |
| Data Byte 8,9 | Line Number of Start of Bottom Bar | | | | | | | |
| Data Byte 10,11 | Pixel Number of End of Left Bar | | | | | | | |
| Data Byte 12,13 | Pixel Number of Start of Right Bar | | | | | | | |
| Data Byte 14・・・27 | Reserved (0) | | | | | | | |

FIG.8

| CT1 | CT0 | IT Content Attribute |
|---|---|---|
| 0 | 0 | Text:generic IT content |
| 0 | 1 | Photograph:still pictures |
| 1 | 0 | Cinema:Movie or home video |
| 1 | 1 | Game:PC or game console video |

DISPLAY DEVICE, IMAGE SIGNAL PROCESSING METHOD, AND PROGRAM

CROSS REFERENCES TO RELATED APPLICATIONS

The present invention contains subject matter related to Japanese Patent Application JP 2007-298618 filed in the Japan Patent Office on Nov. 16, 2007, the entire contents of which being incorporated herein by reference.

BACKGROUND OF THE INVENTION

1. Field of the Invention

The present invention relates to a display device, an image signal processing method, and a program.

2. Description of the Related Art

In recent years, various display devices such as organic EL display (organic Electro-Luminescence display; or also referred to as OLED display (Organic Light Emitting Diode display)), FED (Field Emission Display), LCD (Liquid Crystal Display), PDP (Plasma Display Panel), and projector are being developed as the display device replacing the CRT display (Cathode Ray Tube display).

Among the various display devices, the organic EL display is a self-light emitting display device that utilizes electroluminescence phenomenon, and is being given particular attention as a display device of the next generation as it excels in moving image characteristic, field angle characteristic, color reproducibility, and the like compared to the display device that desirably additionally includes a light source such as the LCD. The electroluminescence phenomenon is a phenomenon in which when the electron state of a substance (organic EL element) changes from a ground state to an excited state by electric field and returns from an unstable excited state to a stable ground state, the difference energy is released as light.

In the related art, various techniques related to the self-light emitting display device are being developed. The technique related to a light emission time control per unit time in the self-light emitting display device is disclosed in Japanese Patent Application Laid-Open No. 2006-38967 and the like.

Furthermore, in recent years, HDMI (High-Definition Multimedia Interface) is being widely used as a communication interface for connecting an image reproducing device such as DVD recorder, set-top box or a game machine including Play Station (registered trademark) series, and the display device described above for displaying the image reproduced by the image reproducing device.

The HDMI is the communication interface for transmitting at high-speed a non-compressed digital image signal and a digital audio signal associated with the relevant image signal. More specifically, the HDMI is defined with TMDS (Transition Minimized Differential signaling) channel for transmitting at high speed the image signal and the audio signal in one direction from an HDMI source to an HDMI sink, a CEC line (Consumer Electronics Control Line) for enabling bidirectional communication between the HDMI source and the HDMI sink, and the like, where the digital image signal, the audio signal, and various control signals can be transmitted and received together on one cable.

SUMMARY OF THE INVENTION

The technique of the related art related to the light emission time control per unit time detects information indicating whether the image represented by the image signal in frame units is a moving image or a still image based on the externally input image signal, and adjusts a maximum signal tolerance level and a duty ratio of the image signal based on the detected information. Specifically, the technique of the related art related to the light emission time control per unit time reduces the duty ratio which defines the light emission time per frame and raises the maximum signal tolerance level when the detected information indicates moving image. The technique of the related art related to the light emission time control per unit time increases the duty ratio which defines the light emission time per frame and lowers the maximum signal tolerance level when the detected information indicates still image.

However, if the image represented by the image signal transmitted through the high-speed communication interface such as HDMI is an image of high-definition HD (High Definition) resolution, an enormous signal processing is carried out to detect the information indicating whether the image represented by the image signal in frame units is a moving image or a still image. Thus, if the image represented by the image signal is an image of high-definition HD (High Definition) resolution, the possibility of occurrence of mistaken detection and delay in processing is high. In this case, the change in discontinuous brightness and flickers of the image displayed at a timing of switching of the display control may be visually recognized by the user as an uncomfortable feeling. Therefore, higher image quality may not be achieved in the technique of the related art related to the light emission time control per unit time.

In view of the above issues, it is desirable to provide a novel and improved display device, an image signal processing method, and a program capable of achieving higher image quality by controlling the light emission time in which the light emitting element emits light per unit time according to the type of content of the input image signal and also controlling the gain of the image signal.

According to an embodiment of the present invention, there is provided a display device equipped with a display unit in which light emitting elements which self-emits light according to current amount are arranged in a matrix form, the display device including a receiving part for receiving a difference signal of a plurality of channels including an image signal and content identification information for defining a type of content inserted in a blanking period of at least one channel, and outputting the image signal and the content identification information; a light emission amount regulation part for setting a reference duty for defining a light emission amount per unit time in the respective light emitting element according to image information of the image signal; an adjustment part for adjusting so that an actual duty defining a light emission time for light emitting the light emitting element per unit time is within a predetermined range based on the reference duty and an adjustment signal, and adjusting a gain of the image signal so that a light emission amount defined by the actual duty and the gain of the image signal becomes the same as the light emission amount defined by the reference duty; and an adjustment signal generation part for generating the adjustment signal for setting a lower limit value of the actual duty based on the content identification information.

According to such configuration, higher image quality can be achieved by controlling the light emission time in which the light emitting element emits light per unit time according to the type of content of the input image signal, and also controlling the gain of the image signal.

The adjustment part may include a light emission time adjustment part for setting a lower limit value according to the adjustment signal, and adjusting the reference duty to the set lower limit value or an upper limit value defined in advance to output as the actual duty when the reference duty set by the light emission amount regulation part is outside the predetermined range; and a gain adjustment part for adjusting the gain of the image signal based on the reference duty set by the light emission amount regulation part and the actual duty output from the light emission time adjustment part.

According to such configuration, higher image quality can be achieved by setting the lower limit value of the actual duty according to the adjustment signal and also controlling the light emission time per unit time and the gain of the image signal.

The gain adjustment part may attenuate the gain of the image signal according to an increase ratio of the actual duty with respect to the reference duty when the light emission time adjustment part outputs the actual duty adjusted to the lower limit value.

According to such configuration, the light emission time and the image signal both can be adjusted while maintaining the light emission amounts the same.

The gain adjustment part may amplify the gain of the image signal according to a decrease ratio of the actual duty with respect to the reference duty when the light emission time adjustment part outputs the actual duty adjusted to the upper limit value.

According to such configuration, the light emission time and the image signal both can be adjusted while maintaining the light emission amounts the same.

The gain adjustment part may include a first gain correction portion for multiplying the input image signal and the reference duty; and a second gain correction portion for dividing the corrected image signal output from the first gain correction portion with the actual duty output from the light emission time adjustment part.

According to such configuration, the light emission time and the image signal both can be adjusted while maintaining the light emission amounts the same.

The adjustment signal generation part may generate the adjustment signal according to information of the content represented by the content identification information when the information of the content represented by the content identification information represents the same content continuously for a predetermined number of times.

According to such configuration, lowering in image quality originating from the generation of the adjustment signal/control signal over a plurality of times in a short period of time such as one second can be prevented.

An average luminance calculation part for calculating an average of luminance in a predetermined period of the image signals may be further arranged; where the light emission amount regulation part may set the reference duty according to the average luminance calculated in the average luminance calculation part.

According to such configuration, overcurrent is prevented from flowing to the light emitting element by controlling the light emission time per unit time.

The light emission amount regulation part may store a lookup table in which the luminance of the image signal and the reference duty are corresponded, and uniquely sets the reference duty according to the average luminance calculated in the average luminance calculation part.

According to such configuration, the light emission amount per unit time can be regulated.

The predetermined period for the average luminance calculation part to calculate the average of the luminance may be one frame.

According to such configuration, the light emission time in each frame period can be more finely controlled.

The average luminance calculation part may include a current ratio adjustment part for multiplying a correction value for every primary color signal based on a voltage—current characteristic for the every primary signal of the image signal, and an average value calculation part for calculating the average of the luminance in the predetermined period of the image signal output from the current ratio adjustment part.

According to such configuration, an image faithfully following the input image signal can be displayed.

A linear conversion part for gamma correcting the image signal to correct to a linear image signal may be further arranged; wherein the image signal to be input to the light emission amount regulation part may be the corrected image signal.

According to such configuration, overcurrent is prevented from flowing to the light emitting element by controlling the light emission time per unit time.

A gamma conversion part for performing gamma correction corresponding to a gamma characteristic of the display unit on the image signal may be further arranged.

According to such configuration, an image faithfully following the input image signal can be displayed.

According to the embodiments of the present invention described above, there is provided an image signal processing method in a display device equipped with a receiving part for receiving a difference signal of a plurality of channels including an image signal and content identification information for defining a type of content inserted in a blanking period of at least one channel and outputting the image signal and the content identification information, and a display unit in which light emitting elements which self-emits light according to current amount are arranged in a matrix form, the image signal processing method including the steps of generating an adjustment signal for setting a lower limit of an actual duty defining a light emission time for light emitting the light emitting element per unit time based on the content identification information; setting a lower limit value of the actual duty according to the adjustment signal generated in the generating step; setting a reference duty for defining a light emission amount per unit time in the respective light emitting element according to image information of the image signal; and adjusting so that the actual duty is within a predetermined range based on the reference duty and the lower limit value set in the setting step, and adjusting a gain of the image signal so that a light emission amount defined by the actual duty and the gain of the image signal becomes the same as the light emission amount defined by the reference duty.

Through the use of such method, higher image quality can be achieved by controlling the light emission time in which the light emitting element emits light per unit time according to the type of content of the input image signal, and also controlling the gain of the image signal.

According to the embodiments of the present invention described above, there is provided a program used in a display device equipped with a receiving part for receiving a difference signal of a plurality of channels including an image signal and content identification information for defining a type of content inserted in a blanking period of at least one channel and outputting the image signal and the content identification information, and a display unit in which light emitting elements which self-emits light according to current amount are arranged in a matrix form, the program causing a computer to execute the steps of generating an adjustment signal for setting a lower limit of an actual duty defining a light emission time for light emitting the light emitting element per unit time based on the content identification information; setting a lower limit value of the actual duty according to the adjustment signal generated in the generating step; setting a reference duty for defining a light emission amount per unit time in the respective light emitting element according to image information of the image signal; and adjusting so that the actual duty is within a predetermined range based on the reference duty and the lower limit value set in the setting step, and adjusting a gain of the image signal so that a light emission amount defined by the actual duty and the gain of the image signal becomes the same as the light emission amount defined by the reference duty.

According to such program, higher image quality can be achieved by controlling the light emission time in which the light emitting element emits light per unit time according to the type of content of the input image signal, and also controlling the gain of the image signal.

According to the embodiments of the present invention described above, higher image quality can be achieved by controlling the light emission time in which the light emitting element emits light per unit time according to the type of content of the input image signal, and also controlling the gain of the image signal.

BRIEF DESCRIPTION OF THE DRAWINGS

FIG. 7 is an explanatory view showing one example of a data structure of an AVI InfoFrame packet arranged in the data island period according to the embodiment of the present invention;

FIG. 8 is an explanatory view showing one example of content identification information according to the embodiment of the present invention;

DETAILED DESCRIPTION OF THE PREFERRED EMBODIMENTS

Figure 1:
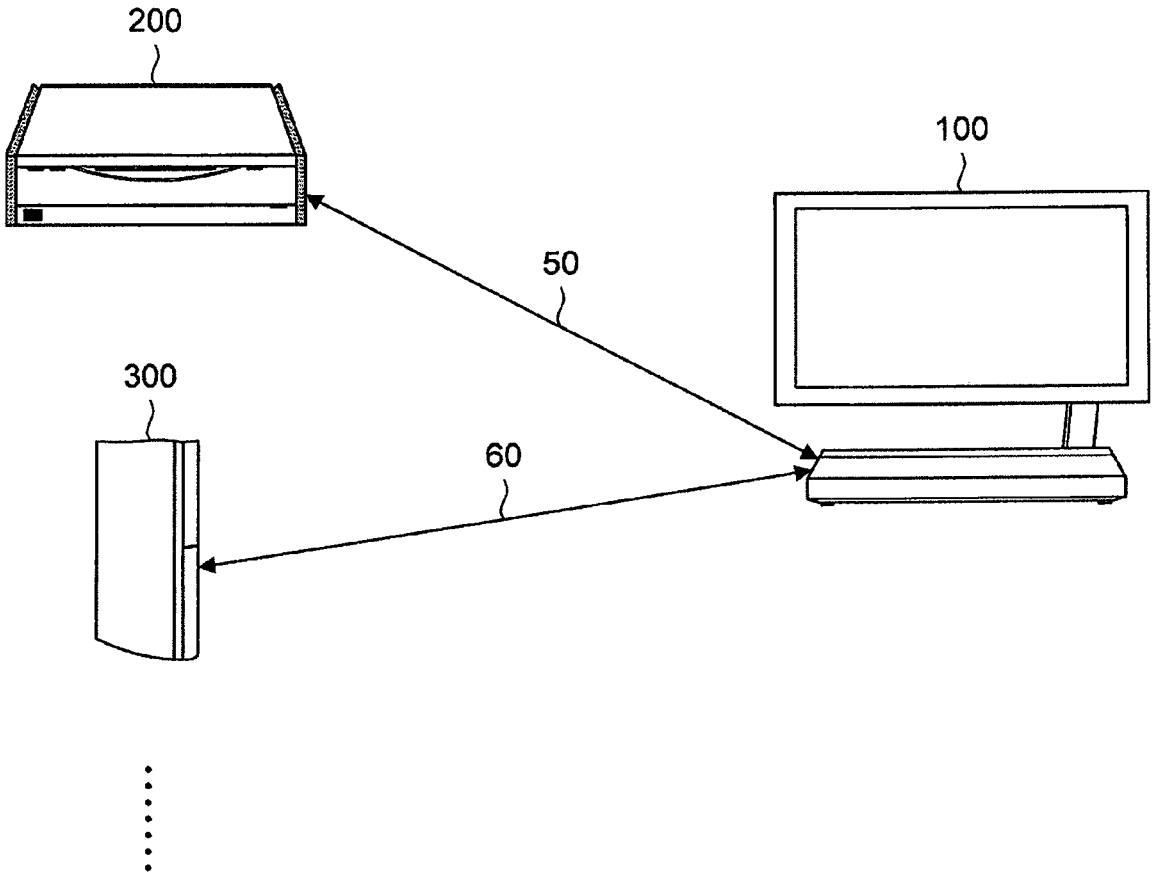
FIG. 1 is an explanatory view showing one example of a configuration of an image display system according to an embodiment of the present invention.

Hereafter, preferred embodiments of the present invention will be described in detail with reference to the appended drawings. Note that in this specification and the appended drawings, structural elements that have substantially the same functions and structures are denoted with the same reference numerals and a repeated explanation of these structural elements is omitted.

(Configuration Example of Image Display System According to an Embodiment of the Present Invention)

First, one example of a configuration of an image display system according to the embodiment of the present invention will be described. FIG. 1 is an explanatory view showing one example of a configuration of the image display system according to the embodiment of the present invention. With reference to FIG. 1, the image display system according to the embodiment of the present invention includes image reproducing devices 200, 300, . . . for reproducing image data and outputting an image signal representing the reproduced image, and a display device 100 for displaying the image based on the image signal output from the image reproducing device. The image reproducing devices 200, 300, . . . and the display device 100 are connected with communication interfaces 50, 60, . . . .

An organic EL display, which is a self-light emitting display device, will be hereinafter described by way of example as the display device 100. The HDMI will be hereinafter described by way of example as communication interfaces 50, 60, . . . , but the communication interface in the image display system according to the embodiment of the present invention is not limited to the HDMI, and may be a communication interface using D terminal, and the like.

Figure 2:
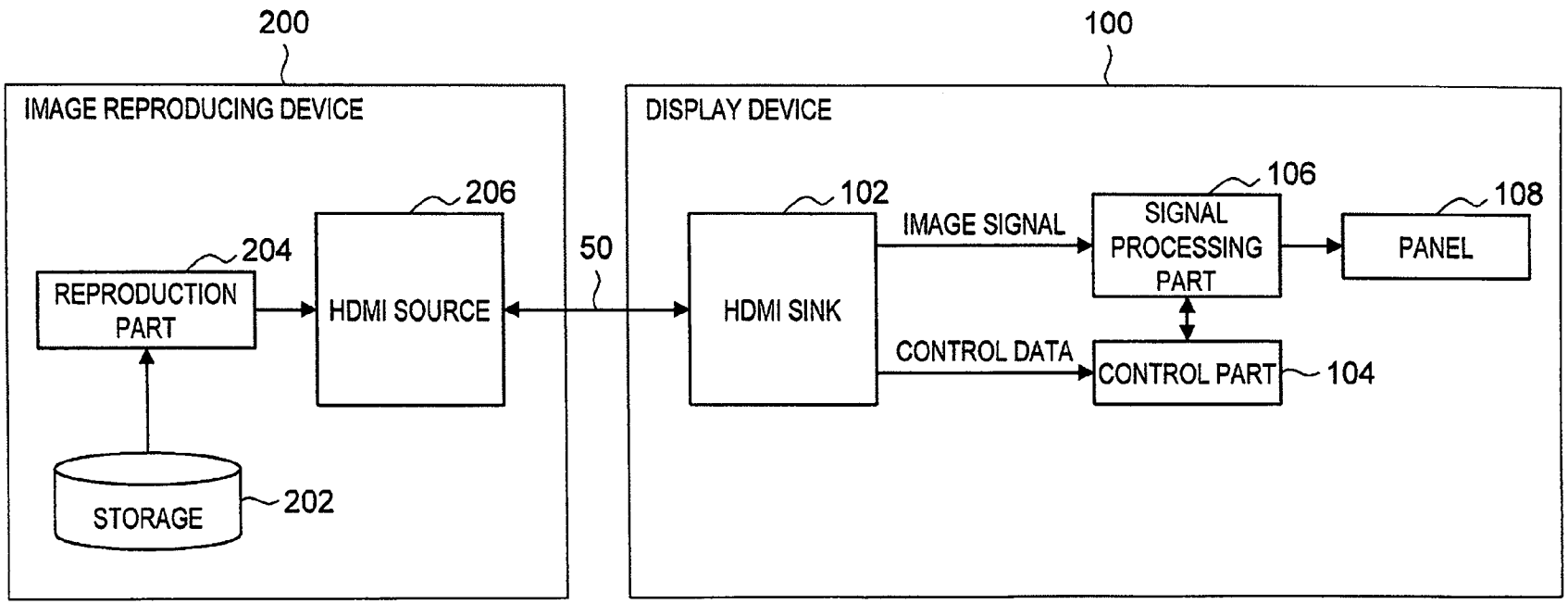
FIG. 2 is a block diagram showing an outline of a configuration of an image reproducing device and a display device according to the embodiment of the present invention.

The outline of the configuration of the image reproducing devices 200, 300, . . . , and the display device 100 will be described below. FIG. 2 is a block diagram showing an outline of the configuration of the image reproducing device and the display device according to the embodiment of the present invention. In FIG. 2, the image reproducing device 200 will be described by way of example, but the image reproducing device 300, . . . can also have a similar configuration.

[Image Reproducing Device 200]

With reference to FIG. 2, the image reproducing device 200 includes a storage 202, a reproduction part 204, and an HDMI source 206.

The image reproducing device 200 is configured to have an MPU (Micro Processing Unit), and the like, and may include a control part (not shown) for performing various calculation processes using a control program etc. and controlling the entire image reproducing device 200, a ROM (Read Only Memory; not shown) recorded with program and control data such as calculation parameter used by the control part (not shown), a RAM (Random Access Memory; not shown) for primary storing the program etc. to be executed by the control part (not shown), an operation part (not shown) operable by the user, and the like. The image reproducing device 200 connects each configuring elements with a bus serving as a data transmission path.

The operation part (not shown) may be an operation input device such as keyboard and mouse, a button, a direction key, a rotatable selector such as jog-dial, or a combination thereof, but is not limited thereto.

The storage 202 is a storage member arranged in the image reproducing device 200, and stores image data and various files such as application and application data. The image data includes data (indicate still image) recorded in a still image format such as JPEG (Joint Photographic Experts Group), bitmap, and the like, and data (indicate moving image) recorded in a moving image format such as WMV (Windows Media Video), H.264/MPEG-4 AVC (H.264/Moving Picture Experts Group phase-4 Advanced Video Coding), and the like, but is not limited thereto.

The storage 202 includes a magnetic recording medium such as hard disc, and a non-volatile memory such as EEPROM (Electrically Erasable and Programmable Read Only Memory), flash memory, MRAM (Magnetoresistive Random Access Memory), FeRAM (Ferroelectric Random Access Memory), PRAM (Phase change Random Access Memory) and the like, but is not limited thereto.

In FIG. 2, a configuration in which the image reproducing device 200 includes the storage 202 is shown, but the image reproducing device according to the embodiment of the present invention is not limited to the configuration including the storage. The image reproducing device according to the embodiment of the present invention includes an optical disc drive for reading the image data recorded in the still image format or the moving image format from an optical disc serving as an external recording medium, and a slot for accommodating an external memory serving as the external recording medium, and is capable of reading the image data from the optical disc and the external memory. The optical disc may be DVD disc, Blu-Ray disc, HD DVD disc, and the like, but is not limited thereto. The external memory may be memory stick, SD memory card, and the like, but is not limited thereto. Needless to say, the image reproducing device according to the embodiment of the present invention may include the storage, and/or, the optical disc drive, and/or the slot.

The reproduction part 204 decodes the image data and the audio data associated with the image data read from the storage 202 and the external recording medium in MPEG (Moving Picture Experts Group) method and the like. The reproduction part 204 then transmits the image signal (image signal corresponding to the image represented by the image data) and the audio signal (audio signal corresponding to the audio represented by the audio data) of baseband to an external device such as display device 100 via the HDMI source 206.

According to the communication complying with the HDMI, the HDMI source 206 transmits the image signal and the audio signal of the baseband transmitted from the reproduction part 204 in one direction to the display device 100 in a difference signal of a plurality of channels. That is, the HDMI source 206 functions as a transmission part.

The HDMI source 206 inserts the content type of the image represented by the image signal to transmit, that is, the content identification information for identifying to what content the image represented by the image signal is related during a blanking period of the image signal to transmit. In other words, the HDMI source 206 functions as an identification information insertion part. The HDMI source 206 can transmit the content identification information using at least one channel of the plurality of channels. The HDMI source 206 is not limited to the content identification information, and various control data can be transmitted using one of the plurality of channels. The details of the HDMI source 206 and the content identification information will be hereinafter described.

According to the configuration shown in FIG. 2, the image reproducing device 200 reproduces the image data, and can output the image signal representing the reproduced image etc. in the difference signal of a plurality of channels.

[Display Device 100]

The display device 100 includes an HDMI sink 102, a control part 104, a signal processing part 106, and a panel 108.

The display device 100 may include a ROM (not shown) recorded with program and control data such as calculation parameter used by the control part 104, a RAM (not shown) for primary storing the program etc. to be executed by the control part 104, an operation part (not shown) operable by the user, a recordation part 130, a storage 132, an overcurrent detection part 134, a data driver 136, a gamma circuit 138, and the like. The display device 100 connects each configuring elements with a bus serving as a data transmission path.

The operation part (not shown) may be an operation input device such as keyboard and mouse, a button, a direction key, a rotatable selector such as jog-dial, or a combination thereof, but is not limited thereto.

According to the communication complying with the HDMI, the HDMI sink 102 receives the difference signal of a plurality of channels transmitted in one direction from the HDMI source 206 of the image reproducing device 200, and outputs image signal, audio signal, and various control data such as content identification information. In other words, the HDMI sink 102 functions as a receiving part. In FIG. 2, an example where the image signal and the control data are output from the HDMI sink is shown. The audio signal received by the HDMI sink 102 is output to an audio signal processing circuit (not shown) and the like, and after being subjected to a predetermined signal processing such as gain adjustment, the audio is output from an audio reproduction part (not shown) such as speaker.

The control part 104 is configured to have MPU and the like, and is capable of controlling the entire display device 100.

The control part 104 processes the control data transmitted from the HDMI sink 102, and transmits an adjustment signal (to be hereinafter described) and a control signal (to be hereinafter described) for controlling various processes in the signal processing part 106 based on the control data to the signal processing part 106. The control part 104 generates the control signal (to be hereinafter described) and the adjustment signal (to be hereinafter described) based on the content identification information. Therefore, the control part 104 functions as an adjustment signal generation part and a control signal generation part.

The control part 104 may perform signal processing on the signal transmitted from the signal processing part 106, and forward the processing result to the signal processing part 106.

The signal processing part 106 performs a predetermined process on the image signal transmitted from the HDMI sink 102, and transmits the processed image signal to the panel 108. The details of the signal processing part 106 will be hereinafter described.

The panel 108 is a display unit arranged in the display device 100. The panel 108 includes a plurality of pixels arranged in a matrix form (rows and columns). The panel 108 includes a data line to be applied with an electric signal corresponding to the image signal corresponding to each pixel, and a scan line to be applied with a selection signal. For instance, the panel 108 for displaying an image of SD (Standard Definition) resolution has at least 640 I·480=307200 (data line I·scan line) pixels, and has 640 I·480 I·3=921600 (data line I·scan line I·number of sub-pixels) sub-pixels if the relevant pixel includes sub-pixels of red (hereinafter referred to as "R"), green (hereinafter referred to as "G"), and blue (hereinafter referred to as "B") for color display. Similarly, the panel 108 for displaying the image of HD resolution has 1920 I·1080 pixels, and has 1920 I·1080 I·3 sub-pixels in the case of color display.

[Application Example of Sub-pixel (Light Emitting Element): Organic EL Element]

When the light emitting element configuring the sub-pixel of each pixel is an organic EL element, The IL characteristic (current-light emission amount characteristic) becomes linear. The display device 100 includes a gamma conversion part 162 (to be hereinafter described), where the relationship between the light quantity of a subject represented by the image signal and the current amount to be applied to the light emitting element can become linear by performing gamma correction. Therefore, the display device 100 can display a moving image or a still image faithfully following the image signal since the relationship between the light quantity of the subject represented by the image signal and the light emission amount is linear.

Furthermore, the panel 108 includes a pixel circuit (not shown) for controlling the current amount to be applied for every pixel. The pixel circuit is configured to have a switch element and a drive element for controlling the current amount by the scan signal and the voltage signal to be applied, and a capacitor for holding the voltage signal. The switch element and the drive element are configured to have a thin film transistor and the like. Since the respective VI characteristic differs in the transistor arranged in the pixel circuit, the VI characteristic of the panel 108 as a whole differs from the VI characteristic of the panel of another display device having the same configuration as the display device 100. Therefore, the display device 100 performs gamma correction corresponding to the panel 108 so as to cancel out the VI characteristic of the panel 108 in the gamma conversion part 162 (to be hereinafter described) and obtain a linear relationship between the light quantity of the subject represented by the image signal and the current amount to be applied to the light emitting element.

According to the configuration shown in FIG. 2, the display device 100 according to the embodiment of the present invention receives the difference signal of a plurality of channels transmitted from the image reproducing device 200, and can display the moving image or the still image corresponding to the image signal contained in the difference signal. The configuration of the signal processing part 106 of the display device 100 will be hereinafter described.

According to the configuration shown in FIG. 2, the image display system according to the embodiment of the present invention can display the moving image or the still image corresponding to the image signal contained in the difference signal of a plurality of channels transmitted from the image reproducing device 200 in the display device 100.

(Example of Communication Interface According to the Embodiment of the Present Invention)

The communication interface according to the embodiment of the present invention will be described below in more detail.

[Outline of Communication Interface]

Figure 3:
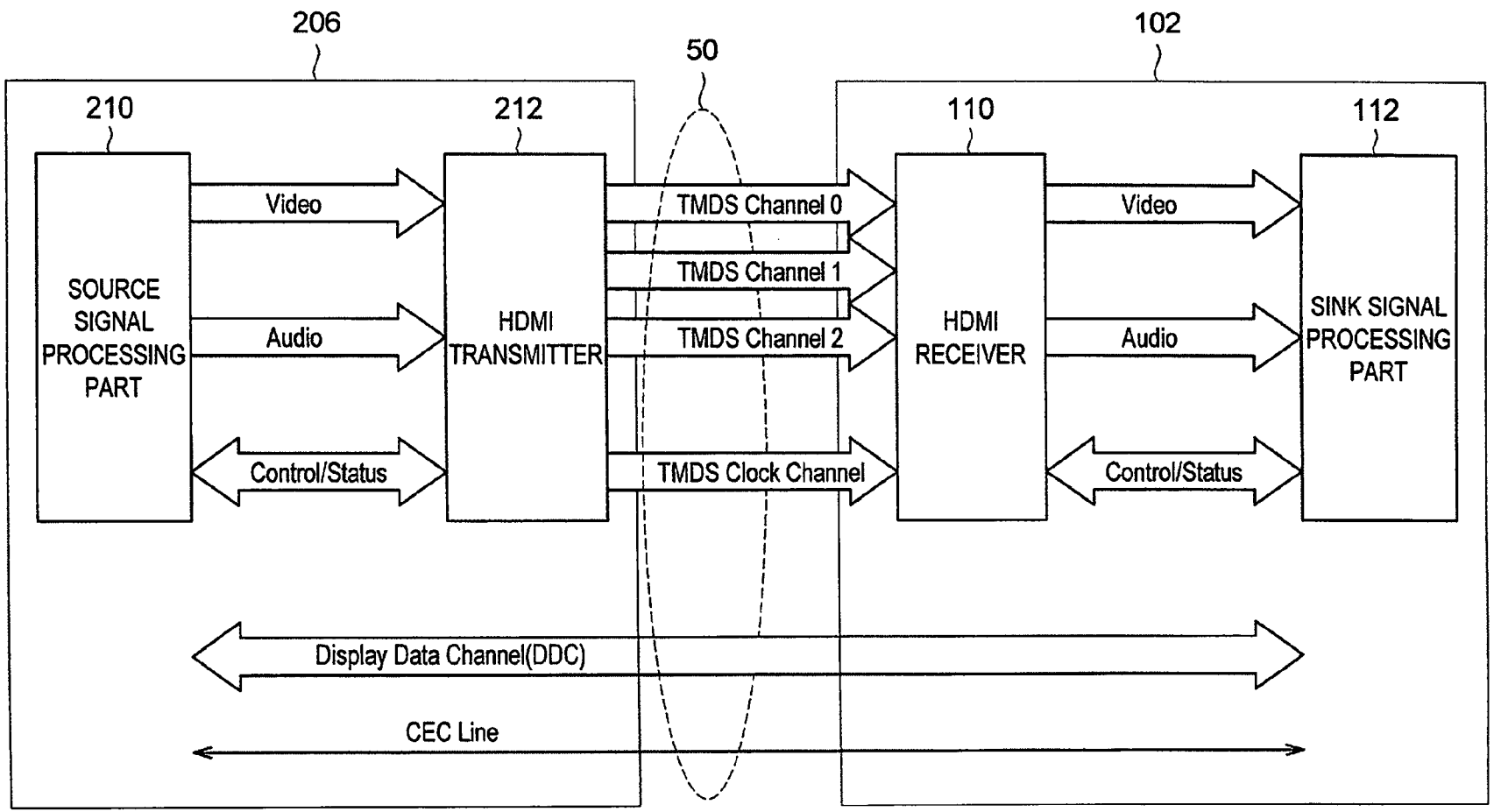
FIG. 3 is an explanatory view showing one example of a communication interface according to the embodiment of the present invention.

First, the outline of the communication interface according to the embodiment of the present invention will be shown. FIG. 3 is an explanatory view showing one example of the communication interface according to the embodiment of the present invention, and specifically shows a configuration example of the HDMI source 206 and the HDMI sink 102 shown in FIG. 2.

[HDMI Source 206]

In effective image period (hereinafter referred to as "active video period"), which is a period excluding a horizontal blanking period and a vertical blanking period from a period (hereinafter referred to as "video field") from a certain vertical synchronous signal to a next vertical synchronous signal, the HDMI source 206 transmits a difference signal corresponding to the image signal of a baseband worth one screen to the HDMI sink 102 in one direction in a plurality of channels.

In the horizontal blanking period and the vertical blanking period, the HDMI source 206 transmits a difference signal corresponding to auxiliary data such as audio signal and control packet associated with the image signal of the baseband to the HDMI sink 102 in one direction in a plurality of channels.

The HDMI source 206 includes a source signal processing part 210 and an HDMI transmitter 212. The source signal processing part 210 transmitted with the image signal and the audio signal of the baseband from the reproduction part 204 transmits the image signal (video) and the audio signal (audio) to the HDMI transmitter 212 after performing a predetermined process. The source signal processing part 210 can also exchange control information, information notifying status (control/status), and the like as necessary with the HDMI transmitter 212.

The HDMI transmitter 212 converts the image signal of the baseband transmitted from the source signal processing part 210 to the corresponding difference signal, and transmits the relevant difference signal in one direction to the HDMI sink 102 connected by way of a cable using three TMDS channels 0 to 2 (one example of the plurality of channels).

The HDMI transmitter 212 converts the auxiliary data such as audio signal and control packet of the baseband, and the control data such as vertical synchronous signal (VSYNC), the horizontal synchronous signal (HSYNC), the content identification information, and the like transmitted from the source signal processing part 210 to the corresponding difference signal, and transmits the relevant difference signal in one direction to the HDMI sink 102 using the TMDS channels 0 to 2. In FIG. 3, three TMDS channels 0 to 2 are shown, but the number of TMDS channels in the embodiment of the present invention is not limited to three.

Furthermore, the HDMI transmitter 212 transmits to the HDMI sink 102 in a TMDS clock channel synchronized with the image signal to be transmitted using the TMDS channels 0 to 2.

[HDMI Sink 102]

The HDMI sink 102 receives the difference signal corresponding to the image signal of the baseband transmitted from the HDMI source 206 by the plurality of channels in the active video period. The HDMI sink 102 receives the audio signal and the difference signal corresponding to the control data transmitted from the HDMI source 206 by the plurality of channels in the horizontal blanking period and the vertical blanking period.

The HDMI sink 102 includes a HDMI receiver 110 and a sink signal processing part 112. The HDMI receiver 110 receives the difference signal corresponding to the image signal, the difference signal corresponding to the audio signal, and the difference signal corresponding to the control data transmitted using the TMDS channels 0 to 2 from the HDMI source 206 in synchronization with a pixel clock transmitted on a TMDS clock channel from the HDMI source 206.

The HDMI receiver 110 converts the received difference signals respectively to the corresponding image signal, the audio signal, and the control data, and appropriately transmits the same to the sink signal processing part 112.

The sink signal processing part 112 performs a predetermined process on various signals transmitted from the HDMI receiver 110. The sink signal processing part 112 transmits the control data to the control part 104, the image signal to the signal processing part 106, and the audio signal to the audio signal processing circuit (not shown) and the like. The sink signal processing part 112 can exchange control information, information notifying status (control/status), and the like as necessary with the HDMI receiver 110.

As described above, the communication interface according to the embodiment of the present invention can transmit the image signal, the audio signal, the control data, and the like from the HDMI source 206 to the HDMI sink 102 using the plurality of TMDS channels and the TMDS clock channel.

[Other Transmission Channels]

The transmission channel of the communication interface (HDMI) according to the embodiment of the present invention may also include transmission channels referred to as DDC (Display Data Channel) and CEC line in addition to the TMDS channels 0 to 2, and the TMDS clock channel.

The DDC is used by the HDMI source 206 to read out E-EDID (Enhanced Extended Display Identification) from the HDMI sink 102 connected by way of a cable. E-EDID is performance information related to self performance (configuration/capability), and such E-EDID is stored in a ROM (not shown) arranged in the HDMI sink 102.

When the HDMI source 206 reads out the E-EDID from the HDMI sink 102 using the DDC, the HDMI source 206 can recognize the format (profile) of the image corresponding to the HDMI sink 102 such as RGB, YCbCr 4:4:4, YCbCr 4:2:2 etc., that is, the format (profile) of the image corresponding to the display device 100 based on the E-EDID.

Similar to the HDMI sink 102, the HDMI source 206 stores the E-EDID indicating the performance of the HDMI source 206, and can transmit the relevant E-EDID appropriately to the HDMI sink 102.

The CEC line is used in bidirectional communication of control data etc. between the HDMI source 206 and the HDMI sink 102.

[Details of Communication Interface]

The communication interface according to the embodiment of the present invention will be described in more detail below.

[Configuration Example of HDMI Transmitter 212 and HDMI Receiver 110]

Figure 4:
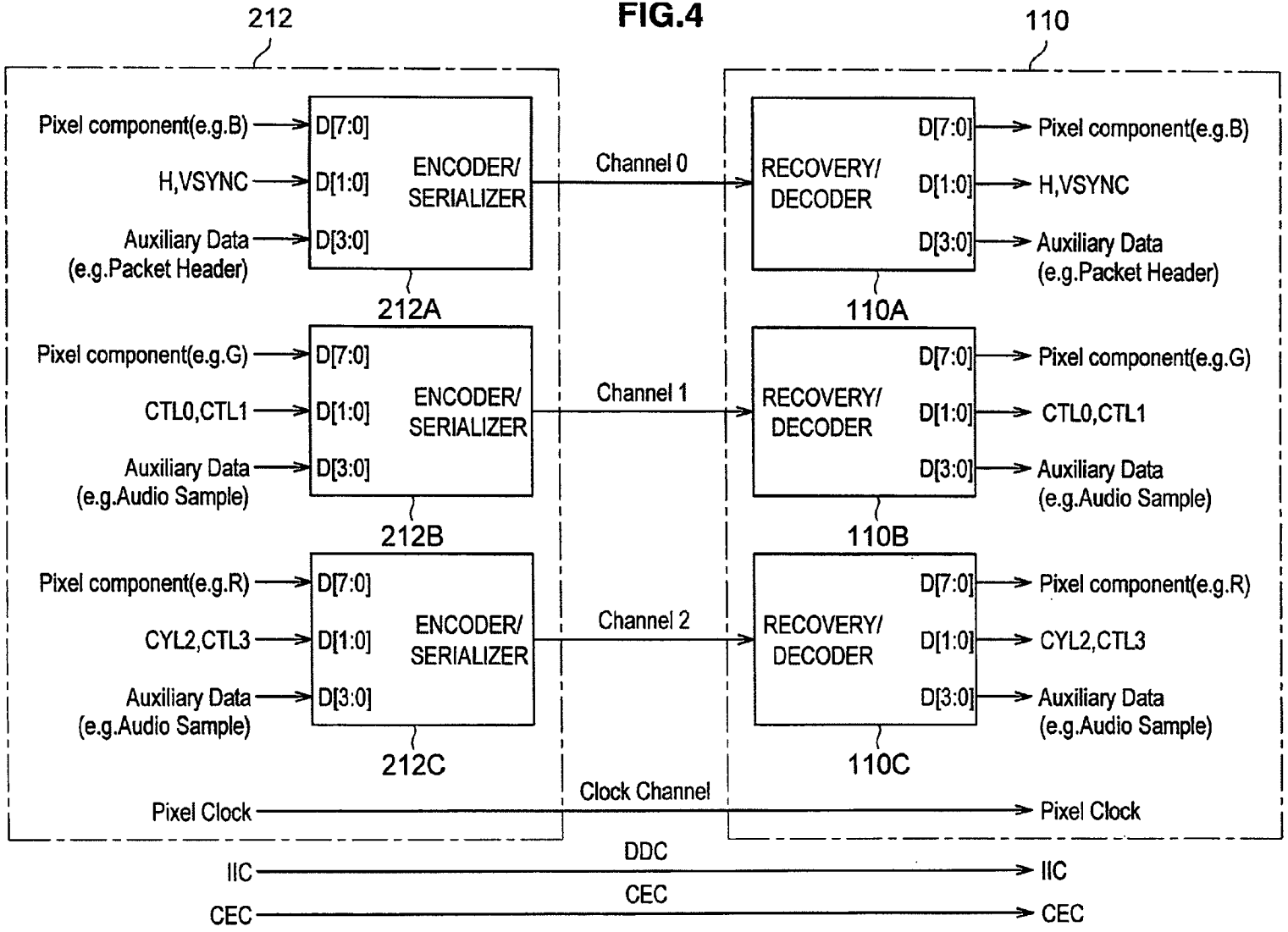
FIG. 4 is an explanatory view showing a configuration example of an HDMI transmitter and an HDMI receiver according to the embodiment of the present invention.

FIG. 4 is an explanatory view showing a configuration example of the HDMI transmitter 212 and the HDMI receiver 110 according to the embodiment of the present invention.

[A] HDMI Transmitter 212

The HDMI transmitter 212 includes encoder/serializers 212A, 212B, and 212C respectively corresponding to the TMDS channels 0 to 2. The encoder/serializers 212A, 212B, and 212C encode the transmitted image signal, the auxiliary data, the control data and the like, convert parallel data to serial data, and transmit the data by a difference signal.

If the image signal has three components of RGB, the B component is transmitted to the encoder/serializer 212A, the G component is transmitted to the encoder/serializer 212B, and the R component is transmitted to the encoder/serializer 212C.

The auxiliary data includes audio signal and control packet. The control packet is transmitted to the encoder/serializer 212A, and the audio signal is transmitted to the encoder/serializers 212B, 212C.

The control data includes one bit of vertical synchronous signal (VSYNC), one bit of horizontal synchronous signal (HSYNC), and one bit of control bits CTL0, CTL1, CTL2, and CTL3.

The vertical synchronous signal and the horizontal synchronous signal are transmitted to the encoder/serializer 212B etc. The control bits CTL0 and CTL1 are transmitted to the encoder/serializer 212B, and the control bits CTL2, CTL3 are transmitted to the encoder/serializer 212C.

[A-1] Encoder/Serializer 212A

The encoder/serializer 212A transmits the various transmitted signals in time division. For example, if the B component of the image signal is transmitted, the encoder/serializer 212A divides the B component to parallel data of eight bit units, which is a predetermined number of bits, and encodes the same, and then converts the parallel data to serial data and transmits the data to the HDMI receiver 110 using the TMDS channel 0.

If the vertical synchronous signal and the horizontal synchronous signal are transmitted, for example, the encoder/serializer 212A encodes the same to two bits of parallel data, converts the parallel data to the serial data, and transmits the data to the HDMI receiver 110 using the TMDS channel 0.

Furthermore, if the auxiliary data is transmitted, the encoder/serializer 212A divides the auxiliary data to parallel data of four bit units, encodes the same, coverts the parallel data to the serial data and transmits the data to the HDMI receiver 110 using the TMDS channel 0.

[A-2] Encoder/Serializer 212B

Similar to the encoder/serializer 212A, the encoder/serializer 212B transmits the various transmitted signals in time division. For example, if the G component of the image signal is transmitted, the encoder/serializer 212B divides the G component to parallel data of eight bit units, which is a predetermined number of bits, and encodes the same, and then converts the parallel data to serial data and transmits the data to the HDMI receiver 110 using the TMDS channel 1.

If the control bits CTL0, CTL1 are transmitted, for example, the encoder/serializer 212B encodes the same to two bits of parallel data, converts the parallel data to the serial data, and transmits the data to the HDMI receiver 110 using the TMDS channel 1.

Furthermore, if the auxiliary data is transmitted, the encoder/serializer 212B divides the auxiliary data to parallel data of four bit units, encodes the same, coverts the parallel data to the serial data and transmits the data to the HDMI receiver 110 using the TMDS channel 1.

[A-3] Encoder/Serializer 212C

Similar to the encoder/serializer 212A, the encoder/serializer 212C transmits the various transmitted signals in time division. For example, if the R component of the image signal is transmitted, the encoder/serializer 212C divides the R component to parallel data of eight bit units, which is a predetermined number of bits, and encodes the same, and then converts the parallel data to serial data and transmits the data to the HDMI receiver 110 using the TMDS channel 2.

If the control bits CTL2, CTL3 are transmitted, for example, the encoder/serializer 212C encodes the same to two bits of parallel data, converts the parallel data to the serial data, and transmits the data to the HDMI receiver 110 using the TMDS channel 2.

Furthermore, if the auxiliary data is transmitted, the encoder/serializer 212C divides the auxiliary data to parallel data of four bit units, encodes the same, coverts the parallel data to the serial data and transmits the data to the HDMI receiver 110 using the TMDS channel 2.

[B] HDMI Receiver 110

The HDMI receiver 110 includes recovery/decoders 110A, 110B, and 110C respectively corresponding to the TMDS channels 0 to 2. The recovery/decoders 110A, 110B, and 110C respectively receive the image signal, the auxiliary data, and the control data transmitted by the difference signal from the HDMI transmitter 212. The recovery/decoders 110A, 110B, and 110C respectively convert the received image signal, the auxiliary data, and the control data from serial data to parallel data, decodes the data and outputs the data.

[B-1] Recovery/Decoder 110A

The recovery/decoder 110A receives, for example, the B component of the image signal, the vertical synchronous signal and the horizontal synchronous signal, and the auxiliary data transmitted on the TMDS channel 0 from the HDMI transmitter 212. The recovery/decoder 110A converts each of the various received signals from serial data to parallel data, decodes the data and outputs the data.

[B-2] Recovery/Decoder 110B

The recovery/decoder 110B receives, for example, the G component of the image signal, the control bits CTL0 and CTL1, and the auxiliary data transmitted on the TMDS channel 1 from the HDMI transmitter 212. The recovery/decoder 110B converts each of the various received signals from serial data to parallel data, decodes the data and outputs the data.

[B-3] Recovery/Decoder 110C

The recovery/decoder 110C receives, for example, the R component of the image signal, the control bits CTL2 and CTL3, and the auxiliary data transmitted on the TMDS channel 2 from the HDMI transmitter 212. The recovery/decoder 110C converts each of the various received signals from serial data to parallel data, decodes the data and outputs the data.

[One Example of Transmission Period in Each TMDS Channel]

Figure 5:
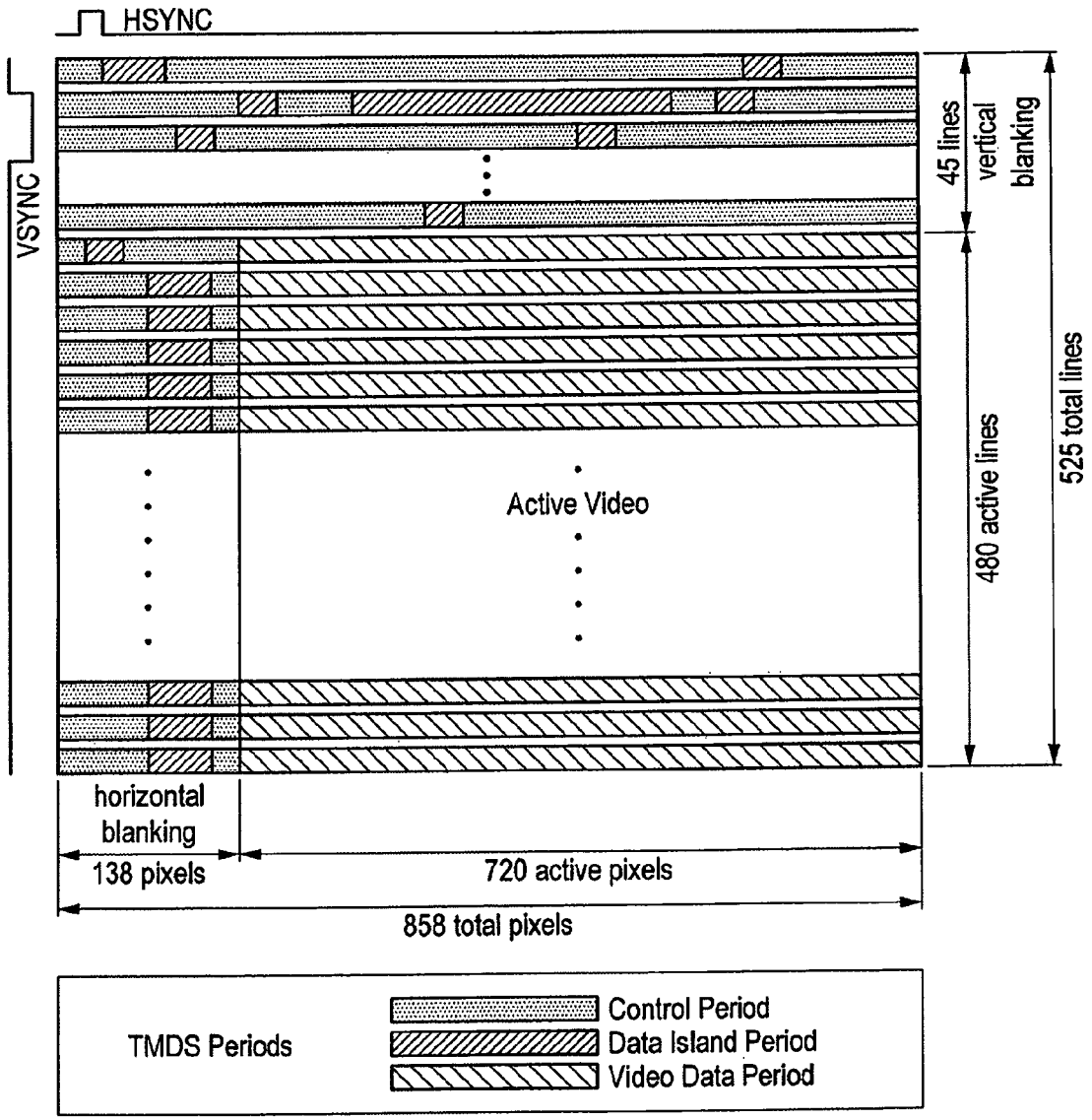
FIG. 5 is an explanatory view showing one example of a transmission period in which various signals are transmitted in each TMDS channel of the HDMI according to the embodiment of the present invention.

FIG. 5 is an explanatory view showing one example of a transmission period in which various signals are transmitted in each TMDS channel of the HDMI according to the embodiment of the present invention. Here, FIG. 5 shows a transmission period of various signals when an image signal indicating a progressive image having a resolution of 720 I·480 is transmitted on the TMDS channels 0 to 2. The various signals transmitted on each TMDS channel are collectively termed as "transmission data" below.

The video field in which the transmission data is transmitted on the TMDS channels 0 to 2 of the HDMI can be divided into three periods, the video data period, the data island period, and the control period, depending on the type of transmission data.

The video field period is a period from an active edge of a certain vertical synchronous signal to an active edge of the next vertical synchronous signal. The video field frame can be divided to a horizontal blanking period, a vertical blanking period, and an active video period, which is a period excluding the horizontal blanking period and the vertical blanking period from the video field period.

The video data period is assigned to the active video period. In the video data period, the signal of an active pixel worth 720 pixels I·480 lines configuring the image signal for one uncompressed screen is transmitted.

The data island period and the control period are assigned to the horizontal blanking period and the vertical blanking period. The auxiliary data is transmitted in the data island period and the control period. The data island period is assigned to one portion of the horizontal blanking period and the vertical blanking period. Data not relevant to control of the auxiliary data such as packet of the audio data are transmitted in the data island period.

The control period is assigned to other portions of the horizontal blanking period and the vertical blanking period. Data relevant to control of the auxiliary data such as vertical synchronous signal, the horizontal synchronous signal, the control packet, and the like are transmitted in the control period.

The frequency of the pixel clock transmitted on the TMDS clock channel in the HDMI according to the embodiment of the present invention may be 165 MHz, in which case the transmission rate of the data island period is about 500 Mbps.

As described above, the auxiliary data is transmitted in both the data island period and the control period, and the distinction thereof is made by the control bits CTL0, CTL1. FIG. 6 is an explanatory view showing one example of a relationship between the control bits CTL0, CTL1 and the data island period and the control period according to the embodiment of the present invention.

Figures 6A, 6B, 6C, 6D:
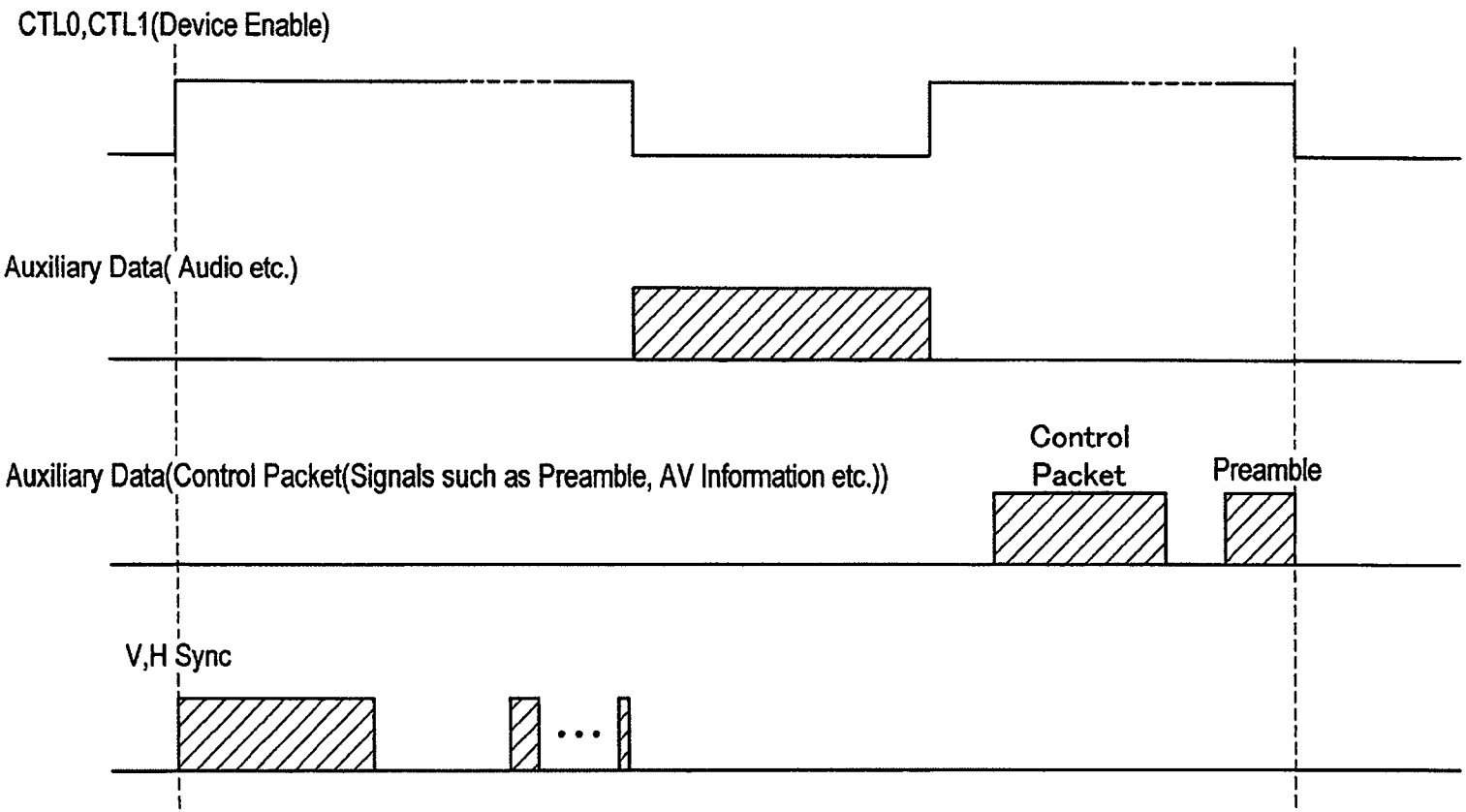
FIG. 6 is an explanatory view showing a relationship between the control bits CTL0, CTL1 and the data island period and the control period according to the embodiment of the present invention.

As shown in FIG. 6A, the control bits CTL0, CTL1 represent two states of a device enable state and a device disable state. The device enable state is represented as high level (High) and the device disable state is represented as low level (Low) in FIG. 6A, but are not limited thereto.

The control bits CTL0, CTL1 are in the device disable state in the data island period and in the device enable state in the control period. Therefore, the data island period and the control period can be distinguished.

In the data island period in which the control bits CTL0, CTL1 are at low level, that is, the control bits CTL0, CTL1 indicate the device disable state, the data not relevant to the control of the auxiliary data such as the audio data are transmitted, as shown in FIG. 6B.

In the control period in which the control bits CTL0, CTL1 are at high level, that is, the control bits CTL0, CTL1 indicate the device enable state, the data relevant to the control of the auxiliary data such as the control packet an preamble are transmitted, as shown in FIG. 6C. The vertical synchronous signal and the horizontal synchronous signal are also transmitted in the control period, as shown in FIG. 6D.

The image display system according to the embodiment of the present invention can display the image signals transmitted from the image reproducing devices 200, 300, . . . by the communication interface shown in FIGS. 3 to 6 on the display device 100.

(Content Identification Information According to the Embodiment of the Present Invention)

The content identification information according to the embodiment of the present invention will now be described. As described above, the content identification information is inserted in the blanking period of the image signal at the HDMI source 206.

FIG. 7 is an explanatory view showing one example of a data structure of an AVI (Auxiliary Video Information) InfoFrame packet arranged in the data island period according to the embodiment of the present invention. In the HDMI according to the embodiment of the present invention, the supplementary information related to the image represented by the image signal can be transmitted from the image reproducing devices 200, 300, . . . to the display device 100 by the AVI InfoFrame packet.

With reference to FIG. 7, the content identification information according to the embodiment of the present invention is arranged hierarchically in one bit of ITC in the sixth byte (Data Byte 3) and in two bits of CT1, CT0 in the eighth byte (Data Byte 5).

For instance, the ITC, which is one bit of data, identifies whether or not the image represented by the image signal is a moving image content. The content represents a normal moving image content if ITC=0, and represents not a normal moving image content if ITC=1. The CT1, CT0, which are two bits of data, become effective when ITC=1. That is, CT1, CT0 are further used when determined as not the normal moving image content by the ITC.

[Example of Content Identification Information]

FIG. 8 is an explanatory view showing one example of the content identification information according to the embodiment of the present invention.

With reference to FIG. 8, the content identification information according to the embodiment of the present invention identifies four contents of "text" content, "photograph" content, "cinema" content, and "game" content. The "text" content represents the general IT (Information Technology" content. The "photograph" content represents the content of still pictures. The "cinema" content represents the content of moving images such as movie and home video. The "game" content represents the content of a PC (Personal Computer) and a game console video.

In FIG. 8, an example where "text" content is represented if CT1=0 and CT0=0, "photograph" content is represented if CT1=0 and CT0=1, "cinema" content is represented if CT1=1 and CT0=0, and "game" content is represented if CT1=1 and CT0=1 is shown, but is should be noted that the content identification information according to the embodiment of the present invention is not limited thereto.

The control part 104 of the display device 100 generates the adjustment signal and the control signal based on the content identification information transmitted from the HDMI sink 102, and transmits the signals to the signal processing part 106. The adjustment signal and the control signal generated by the control part 104 are signals for controlling the processes in the signal processing part 106, where the signal processing part 106 transmitted with the adjustment signal and the control signal skips a process, changes the setting, and the like in response to the transmitted adjustment signal and the control signal. The display device 100 according to the embodiment of the present invention will be described in more detail below.

(Display Device 100 According to the Embodiment of the Present Invention)

Figure 9:
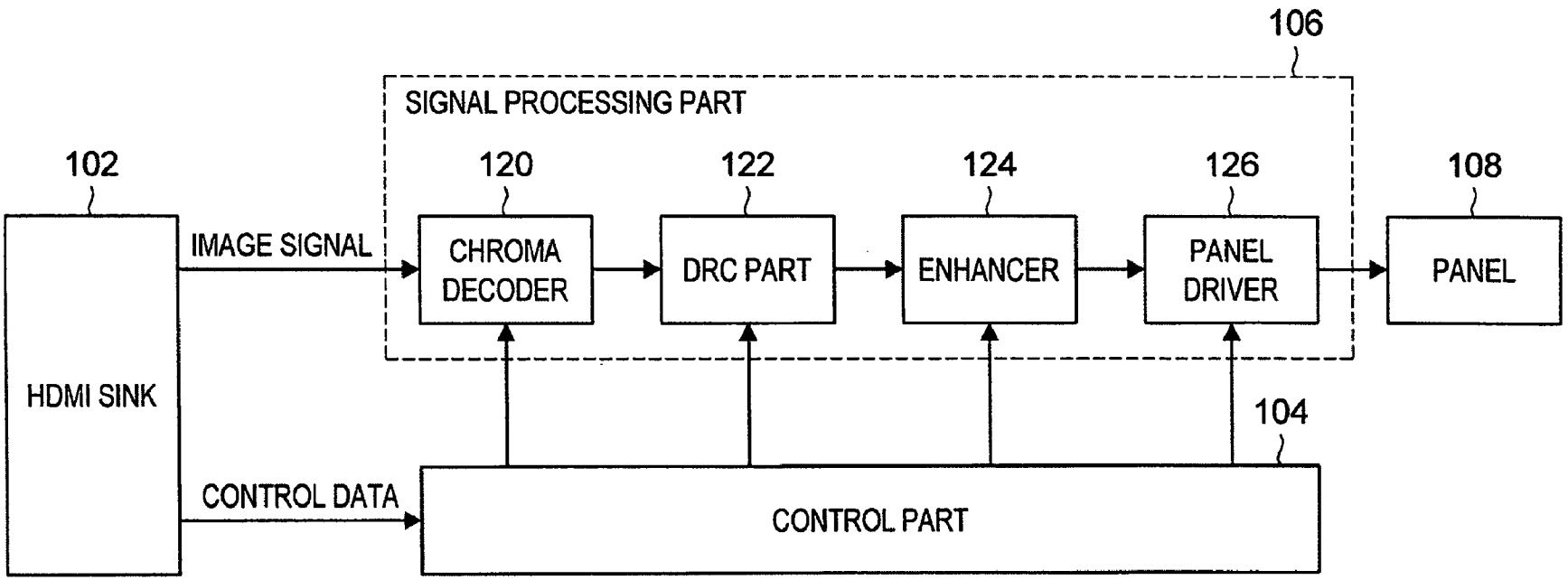
FIG. 9 is an explanatory view showing one example of a configuration of a display device according to the embodiment of the present invention.

FIG. 9 is an explanatory view showing one example of a configuration of the display device 100 according to the embodiment of the present invention. With reference to FIG. 9, the display device 100 includes the HDMI sink 102, the control part 104, the signal processing part 106, and the panel 108, as shown in FIG. 2.

[Signal Processing Part 106]

The signal processing part 106 includes a chroma decoder 120, a DRC part 122, an enhancer 124, and a panel driver 126.

The chroma decoder 120 performs a process related to color such as changing of color space on the image signal transmitted from the HDMI sink 102. The chroma decoder 120 switches the color space to change in response to the control signal transmitted from the control part 104. For instance, the chroma decoder 120 can switch "sRGB (standard RGB)" and "Adobe RGB (registered trademark)" in response to the control signal, but is not limited thereto.

The DRC part 122 improves the image quality by regenerating the image signal corresponding to the pixel of interest, for example according to the image signal corresponding to the pixel of interest and the image signal corresponding to the surrounding pixels of the relevant pixel of interest with respect to the image signal transmitted from the chroma decoder 120. The DRC part 122 also appropriately can make a switch on whether or not to perform the process according to the control signal transmitted from the control part 104.

The enhancer 124 performs a process of edge enhancement on the image signal transmitted from the DRC part 122. The enhancer 124 also appropriately can make a switch on whether or not to perform the process according to the control signal transmitted from the control part 104.

The panel driver 126 performs various processes such as gamma correction within a linear space, control of a ratio of the light emission time of the light emitting element on the unit time (i.e., ratio of light emission and image erasure in unit time; hereinafter referred to as "duty"), and the like on the image signal transmitted from the enhancer 124. The panel driver 126 can change the set value related to the control of duty in response to the adjustment signal transmitted from the control part 104. The detailed configuration example of the panel driver 126 will be hereinafter described.

According to the above-described configuration, the signal processing part 106 can perform various processes on the image signal received by the HDMI sink 102, and transmit the processed image signal to the panel 108.

The control part 104 generates the adjustment signal and the control signal corresponding to the content identification information based on the content identification information of the control data received by the HDMI sink 102, and transmits the same to each part of the signal processing part 106.

The control part 104 can generate the adjustment signal and the control signal corresponding to the information of the content represented by the content identification information when the information of the content represented by the content identification information represents the same content continuously over a predetermined number of times, but is not limited thereto. For instance, the control part 104 can also generate the adjustment signal and the control signal corresponding to the information of the content represented by the content identification information every time the content identification information is transmitted.

[Process of Control Part 104 Based on Content Identification Information]

Figure 10:
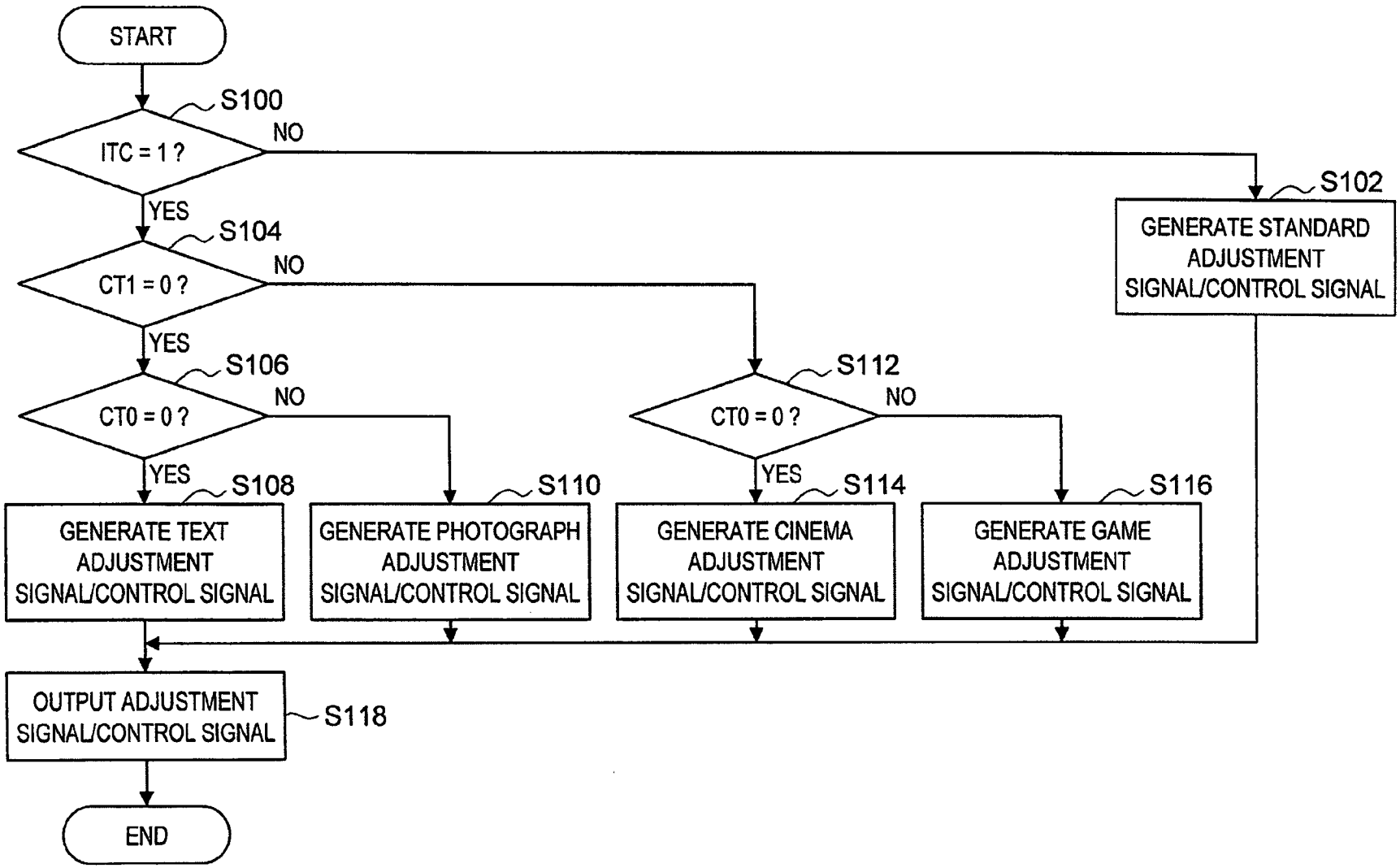
FIG. 10 is a flowchart describing one example of a signal generating method based on the content identification information in the control part of the display device according to the embodiment of the present invention.

FIG. 10 is a flowchart describing one example of a signal generating method based on the content identification information in the control part 104 of the display device 100 according to the embodiment of the present invention. A case where the signal processing part 106 of the display device 100 includes the chroma decoder 120, the DRC part 122, the enhancer 124, and the panel driver 126 as shown in FIG. 9 will be described below by way of example.

The control part 104 determines whether or not the ITC of the content identification information transmitted from the HDMI sink 102 is ITC=1 (S100).

If determined that ITC is not ITC=1 in step S100, the control part 104 generates a standard adjustment signal/control signal (S102), and outputs the generated adjustment signal/control signal (S118). The standard adjustment signal is a signal for setting the set value related to the control of duty to a prescribed standard set value in the panel driver 126 of the signal processing part 106. The standard control signal is a signal for causing the chroma decoder 120, the DRC part 122, and the enhancer 124 of the signal processing part 106 to perform the prescribed standard process.

The control part 104 can perform the process of step S102 when "ITC=0" is input as the content information, but is not limited thereto. For instance, the control part 104 can perform the process of step S102 when "ITC=0" is transmitted from the HDMI sink 102 continuously over a predetermined number of times. As the control part 104 generates the adjustment signal/control signal when the information of the content represented by the content identification information represents the same content continuously over a predetermined number of times, lowering in image quality due to generation of the adjustment signal/control signal over plural times in a short period of one second and the like can be prevented. The control part 104 may hold the value of the ITC for a predetermined number of times and use the value of the ITC being held to determine whether or not the value of the ITC has been input continuously over a predetermined number of times, but is not limited thereto. Similarly in other determination processes (steps S104, S106, S112 to be hereinafter described) shown in FIG. 10, the control part 104 can perform the process corresponding to the determination result when the value of the content identification information used in the determination is input continuously over a predetermined number of times.

If determined as ITC=1 in step S100, the control part 104 determines whether or not the CT1 of the content identification information transmitted from the HDMI sink 102 is CT1=0 (S104).

[1] If Determined as CT1=0

If determined as CT1=0 in step S104, the control part 104 determines whether or not CT0=0 (S106).

If determined as CT0=0 in step S106, the control part 104 generates the adjustment signal/control signal for "text" content (S108), and outputs the generated adjustment signal/control signal (S118).

The adjustment signal for "text" content is a signal for setting the set value related to the control of duty to a predetermined first value (hereinafter described) for making adjustment such that the duty becomes larger in the panel driver 126 of the signal processing part 106. The generation of flickers can be suppressed, that is, the occurrence of an event that lowers the image quality is suppressed, and higher image quality can be achieved by setting the set value related to the control of duty to the first value.

The control signal for "text" content is a signal for causing the chroma decoder 120 and the DRC part 122 to perform the process and not causing the enhancer 124 to perform the process (i.e., skip the process) with respect to the chroma decoder 120, the DRC part 122, and the enhancer 124 of the signal processing part 106. If the image signal received by the HDMI sink 102 is related to the "text" content, the edge enhancement process is not performed in the enhancer 124, so that the visibility of text information such as characters contained in the image represented by the image signal improves, and difficulty in reading the characters can be prevented.

If determined as not CT0=0 in step S106, the control part 104 generates the adjustment signal/control signal for "photograph" content (S110), and outputs the generated adjustment signal/control signal (S118).

The adjustment signal for "photograph" content is a signal for setting the set value related to the control of duty to a predetermined second value (hereinafter described) for making adjustment such that the duty becomes larger in the panel driver 126 of the signal processing part 106. The generation of flickers can be suppressed, and higher image quality can be achieved by setting the set value related to the control of duty to the second value.

The control signal for "photograph" content is a signal for causing the DRC part 122 and the enhancer 124 to perform the process and switching the color space to change in the chroma decoder 120 with respect to the chroma decoder 120, the DRC part 122, and the enhancer 124 of the signal processing part 106. When the control signal for "photograph" content is input, the chroma decoder 120 can switch from "sRGB" to "Adobe RGB (registered trademark)". If the image signal received by the HDMI sink 102 is related to "photograph" content, the chroma decoder 120 switches the color space to change to the color space for still image, so that the display device 100 can display the image (i.e., still image) represented by the image signal at a higher image quality.

[2] If determined as not CT1=0

If determined as not CT1=0 in step S104, the control part 104 determines whether or not CT0=0 (S112).

If determined as CT0=0 in step S112, the control part 104 generates the adjustment signal/control signal for "cinema" content (S114), and outputs the generated adjustment signal/control signal (S118).

The adjustment signal for "cinema" content is a signal for setting the set value related to the control of duty to a predetermined third value (hereinafter described) for making adjustment such that the duty becomes smaller in the panel driver 126 of the signal processing part 106. The generation of movement blurs can be suppressed, that is, the occurrence of an event that lowers the image quality can be suppressed, and higher image quality can be achieved by setting the set value related to the control of duty to the third value.

The control signal for "cinema" content is a signal for causing each of the chroma decoder 120, the DRC part 122, and the enhancer 124 of the signal processing part 106 to perform the prescribed standard process, similar to step S102.

If determined as not CT0=0 in step S112, the control part 104 generates the adjustment signal/control signal for "game" content (S114), and outputs the generated adjustment signal/control signal (S118).

The adjustment signal for "game" content is a signal for setting the set value related to the control of duty to a predetermined fourth value (hereinafter described) for making adjustment such that the duty becomes smaller in the panel driver 126 of the signal processing part 106. The generation of movement blurs can be suppressed, and higher image quality can be achieved by setting the set value related to the control of duty to the fourth value.

The control signal for "game" content is a signal for causing the chroma decoder 120 and the enhancer 124 to perform the process and not causing the DRC part 122 to perform the process (i.e., skip the process) with respect to the chroma decoder 120, the DRC part 122, and the enhancer 124 of the signal processing part 106. If the image signal received by the HDMI sink 102 is related to the "game" content, the image quality improvement process is not performed in the DRC part 122, so that the delay in image to be displayed with respect to the reproduced audio that occurs by the image quality improvement process can be alleviated, and occurrence of an uncomfortable feeling due to mismatch of the audio and the image felt by the user can be prevented.

The control part 104 generates the adjustment signal and the control signal based on the content identification information, and can transmit the same to each part of the signal processing part 106 by using the signal generating method shown in FIG. 10. In FIG. 10, an example where four contents of "text" content, "photograph" content, "cinema" content, and "game" content are used as targets for the content identification information has been described by way of example, but it should be recognized that the control part of the display device according to the embodiment of the present invention is not limited to targeting the four contents.

[Panel Driver 126]

The configuration of the panel driver 126 configuring the signal processing part 106 according to the embodiment of the present invention will be described in more detail below.

Figure 11:
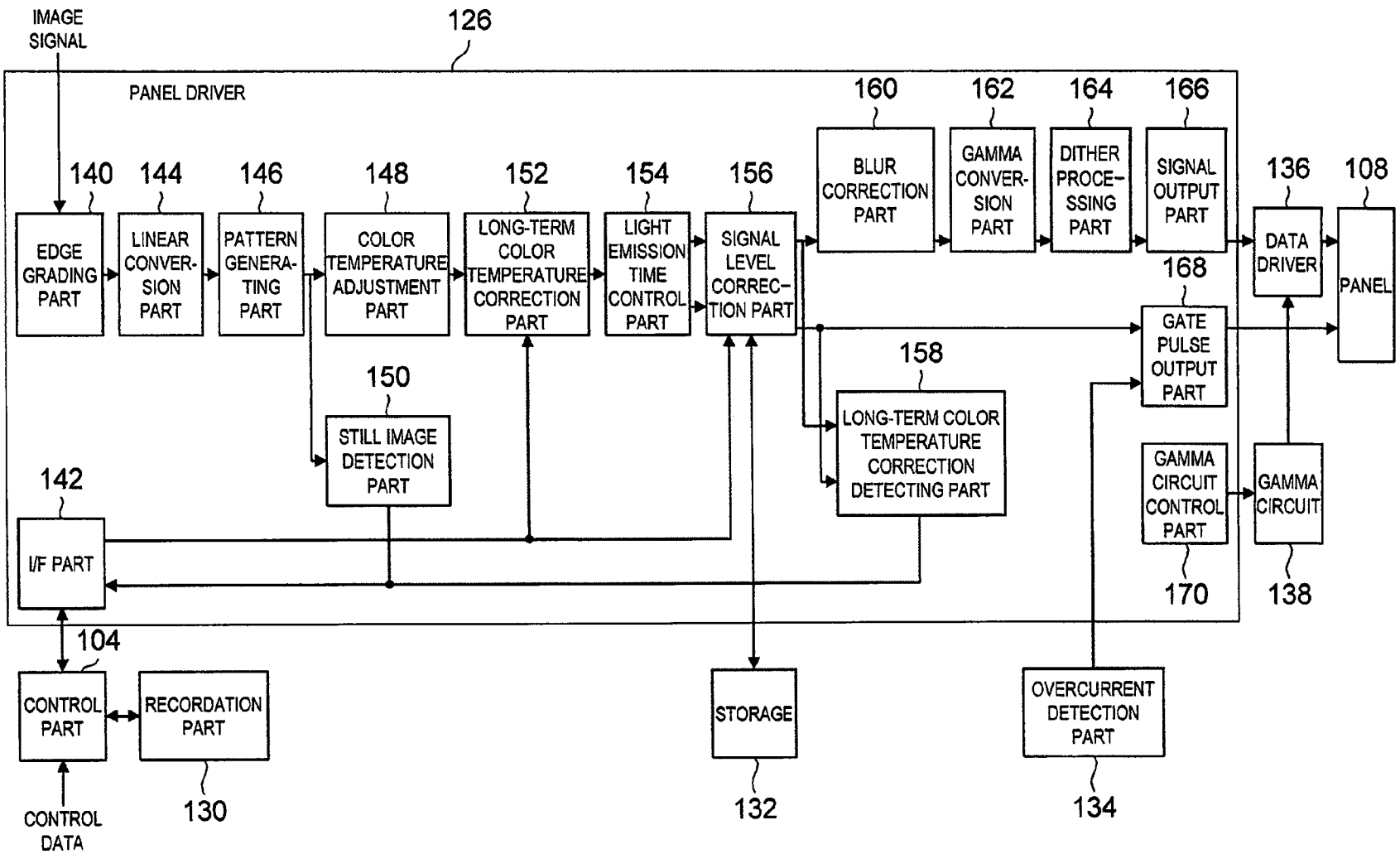
FIG. 11 is a block diagram showing a configuration example of a panel driver of the display device according to the embodiment of the present invention.

FIG. 11 is a block diagram showing a configuration example of the panel driver 126 of the display device 100 according to the embodiment of the present invention. In FIG. 11, the control part 104, the recordation part 130, the storage part 132, the overcurrent detection part 134, the data driver 136, the gamma circuit 138, and the panel 108 configuring the display device 100 are also shown in addition to the panel driver 126.

The recordation part 130 is one storage member arranged in the display device 100, and can hold information for controlling the panel driver 126 in the control part 104. The information held in the recordation part 130 includes a table set in advance with parameters for the control part 104 to perform signal processing on the signal transmitted from the panel driver 126. The recordation part 130 may be a magnetic recording medium such as hard disc, a non-volatile memory such as EEPROM and flash memory, and the like but is not limited thereto.

The panel driver 126 can perform signal processing on the input image signal. The panel driver 126 can perform signal processing with hardware (e.g., signal processing circuit) and/or software (signal processing software). One example of a configuration of the panel driver 126 will be shown below.

[Configuration Example of Panel Driver 126]

The panel driver 126 includes, for example, an edge grading part 140, an I/F part 142, a linear conversion part 144, a pattern generating part 146, a color temperature adjustment part 148, a still image detection part 150, a long-term color temperature correction part 152, a light emission time control part 154, a signal level correction part 156, a long-term color temperature correction detecting part 158, a blur correction part 160, a gamma conversion part 162, a dither processing part 164, a signal output part 166, a gate pulse output part 168, and a gamma circuit control part 170.

The edge grading part 140 performs signal processing to blur the edges with respect to the input image signal. Specifically, the edge grading part 140 blurs the edges by intentionally shifting the image represented by the image signal, and suppresses burn-in phenomenon of the image at the panel 108. The burn-in phenomenon of the image refers to a degrading phenomenon of the light emission characteristic that occurs when the light emission frequency of a specific pixel of the panel 108 is higher than other pixels. The luminance of the pixel degraded by the burn-in phenomenon of the image lowers compared to other pixels that are not degraded. Thus a luminance difference between the degraded pixel and the non-degraded portion at the periphery of the relevant pixel becomes large. Due to such difference in luminance, the characters appear to be burnt in the screen to the user of the display device 100 looking at the video or the image displayed on the display device 100.

The I/F part 142 is an interface for transmitting and receiving signals with components exterior to the panel driver 126 such as control part 104.

The linear conversion part 144 performs gamma correction on the input image signal to correct to a linear image signal. For instance, if the gamma value of the image signal to be input is "2.2", the linear conversion part 144 corrects the image signal so that the gamma value becomes "1.0".

The pattern generating part 146 generates a test pattern to be used in the signal processing in the display device 100. The test pattern to be used in the signal processing in the display device 100 includes a test pattern used in display test of the panel 108, but is not limited thereto.

The color temperature adjustment part 148 adjusts the color temperature of the image represented by the image signal, and adjusts the color to be displayed on the panel 108 of the display device 100. The display device 100 may include a color temperature adjustment member (not shown) enabling the user using the display device 100 to adjust the color temperature. The user can adjust the color temperature of the image to be displayed on the screen by arranging the color temperature adjustment member (not shown) in the display device 100. The color temperature adjustment member (not shown) that may be arranged in the display device 100 includes button, direction key, rotatable selector such as jog dial, or a combination thereof, but is not limited thereto. The color temperature adjustment member (not shown) may be a member integrated with the operation part (not shown).

The still image detection part 150 detects time-series difference of the input image signal and determines that the image signal represents still image if a predetermined time difference is not detected. The detection result of the still image detection part 150 can be used to prevent burn-in phenomenon of the panel 108, and to suppress degradation of the light emitting element.

The long-term color temperature correction part 152 corrects change over time of the R, G, B sub-pixels configuring each pixel of the panel 108. The light emitting element (organic EL element) of each color configuring the sub-pixels of the pixel respectively have different LT characteristic (luminance-time characteristic). Thus, the color when displaying the image represented by the image signal on the panel 108 becomes unbalanced with degradation of the light emitting element over time. Therefore, the long-term color temperature correction part 152 performs compensation of degradation over time of the light emitting element (organic EL element) of each color configuring the sub-pixel.

The light emission time control part 154 controls the light emission time per unit time of each pixel of the panel 108. More specifically, the light emission time control part 154 can control the ratio of the light emission time of the light emitting element on the unit time, that is, the duty. The display device 100 selectively applies current to the pixels of the panel 108 based on the duty to display the image represented by the image signal for a desired time. The "unit time" according to the embodiment of the present invention may be "periodically repeated unit time". The "unit time" is described as "one frame period" in the following description, but it should be noted that the "unit time" according to the embodiment of the present invention is not limited to "one frame period".

The light emission time control part 154 can control the light emission time (duty) so as to prevent overcurrent from flowing to each pixel (more precisely, light emitting element of each pixel) of the panel 108. The overcurrent prevented by the light emission time control part 154 mainly refers to the flow of current larger than the amount of current allowed by the pixel of the panel 108 to the pixel (overload).

Furthermore, the light emission time control part 154 can control the gain of the image signal in addition to the control of the light emission time (duty). As the light emission time control part 154 controls the light emission time (duty) and the gain of the image signal, overcurrent is prevented, occurrence of an event that lowers the image quality such as flickers and movement blur is suppressed, and higher image quality can be achieved.

The configuration of the light emission time control part 154 according to the embodiment of the present invention, and the control of the light emission time and the gain of the image signal in the display device 100 according to the embodiment of the present invention will be hereinafter described in detail.

The signal level correction part 156 determines the risk of occurrence of the burn-in phenomenon of the image to prevent occurrence of the burn-in phenomenon of the image. The signal level correction part 156 corrects the signal level of the image signal to prevent burn-in phenomenon of the image when the risk becomes greater than or equal to a predetermined value to adjust the luminance of the image to be displayed on the panel 108.

The long-term color temperature correction detecting part 158 detects information used to compensate the degradation over time of the light emitting element in the long-term color temperature correction part 152. The information detected in the long-term color temperature correction detecting part 158 is sent to the control part 104 via the I/F part 142, and recorded in the recordation part 130 through the control part 104.

The blur correction part 160 corrects blur of horizontal lines, vertical lines, patches of the entire screen and the like that may occur when the image represented by the image signal is displayed on the panel 108. The blur correction part 160 can make corrections with the level and the coordinate position of the input image signal as references.

The gamma conversion part 162 performs gamma correction on the image signal (more precisely, image signal output from the blur correction part 160) gamma corrected so as to be a linear image signal in the linear conversion part 144, and corrects the image signal so as to have a predetermined gamma value. The predetermined gamma value is a value that can cancel out the VI characteristic (voltage—current characteristic, specifically, VI characteristic of the transistor in the pixel circuit) of the pixel circuit arranged in the panel 108 of the display device 100. When the gamma conversion part 162 performs gamma correction so that the image signal has the predetermined gamma value, the relationship between the light quantity of the subject represented by the image signal and the current amount applied to the light emitting element can be handled as a linear form.

The dither processing part 164 performs dithering on the image signal gamma corrected in the gamma conversion part 162. Dithering is when displaying the displayable colors in combination to represent an intermediate color in an environment with small number of usable colors. The color that originally may not be displayed on the panel 108 then can be created on appearance and displayed on the panel 108 by performing dithering process in the dither processing part 164.

The signal output part 166 outputs the image signal subjected to the dithering process in the dither processing part 164 to the outside of the panel driver 126. The image signal output from the signal output part 166 may be an independent signal for each color of R, G, and B.

The gate pulse output part 18 outputs a selection signal for controlling the light emission and the light emission time of each pixel of the panel 108. The selection signal is based on the duty output from the light emission time control part 154, and the light emitting element of the pixel may emit light when the selection signal is at high level, and the light emitting element of the pixel may not emit light when the selection signal is at low level.

The gamma circuit control part 170 outputs a predetermined set value to the gamma circuit 138 (to be hereinafter described). The predetermined set value output to the gamma circuit 138 by the gamma circuit control part 170 may be a reference voltage to apply to a rudder resistor of a D/A converter (Digital-to-Analog Converter) of the data driver 136 (to be hereinafter described).

The panel driver 126 can perform various signal processing on the input image signal according to the above-described configuration.

The storage part 132 is another storage member arranged in the display device 100. The information held by the storage 132 includes information associating the information on the pixel or the pixel group emitting light exceeding a predetermined luminance and information on the exceeding amount, which are preferable when correcting the luminance in the signal level correction part 156, but is not limited thereto. The storage 132 includes a volatile memory such as SDRAM (Synchronous Dynamic Random Access Memory) and SRAM (Static Random Access Memory), but is not limited thereto, and may be a magnetic recording medium such as hard disc, and a non-volatile memory such as flash memory.

The overcurrent detection part 134 detects overcurrent and notifies the occurrence of overcurrent to the gate pulse output part 168 when overcurrent occurs from short-circuit of wiring at a base (not shown) on which the configuring elements of the display device 100 are arranged. The gate pulse output part 168 notified of the notification of occurrence of overcurrent from the overcurrent detection part 134 does not apply the selection signal to each pixel of the panel 108, so that overcurrent can be prevented from being applied to the panel 108.

The data driver 136 converts the image signal output from the signal output part 166 to a voltage signal to be applied to each pixel of the panel 108, and outputs the voltage signal to the panel 108. The data driver 136 thus includes a D/A converter for converting the image signal serving as a digital signal to the voltage signal serving as an analog signal.

The gamma circuit 138 outputs a reference voltage to apply to the rudder resistor of the D/A converter of the data driver 136. The reference voltage output to the data driver 136 by the gamma circuit 138 can be controlled by the gamma circuit control part 170.

The display device 100 according to the embodiment of the present invention includes the panel driver 126 having the configuration shown in FIG. 11, so that the image corresponding to the image signal received by the HDMI sink 102 can be displayed. In FIG. 11, the panel driver 126 including the pattern generating part 146 at the post-stage of the linear conversion part 144 has been shown, but the configuration is not limited thereto, and the panel driver according to the embodiment of the present invention may include the pattern generating part at the pre-stage of the linear conversion part.

(Outline of Transition of Signal Characteristic in Display Device 100)

The outline of the transition of the signal characteristic in the display device 100 according to the embodiment of the present invention will now be described. FIGS. 12A to 12F are explanatory views showing an outline of the transition of the signal characteristic in the display device 100 according to the embodiment of the present invention.

Figure 12A:
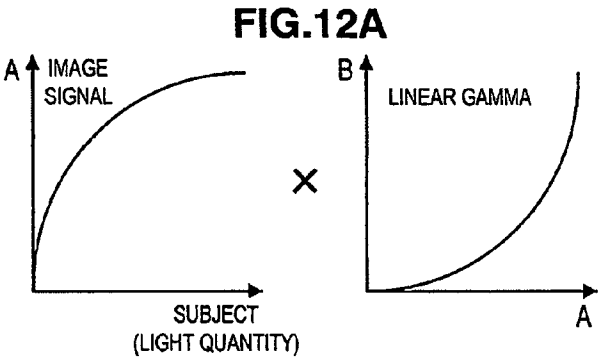
FIG. 12A is an explanatory view showing an outline of transition of the signal characteristic in the display device according to the embodiment of the present invention.
Figure 12B:
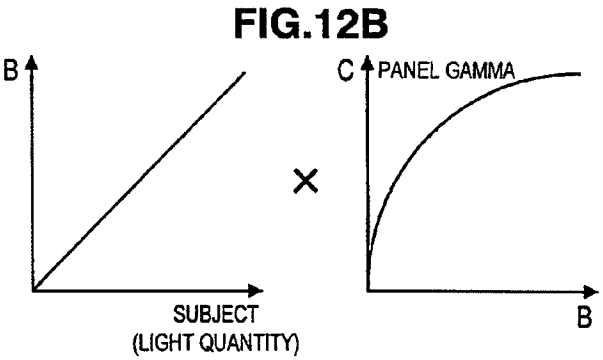
FIG. 12B is an explanatory view showing the outline of transition of the signal characteristic in the display device according to the embodiment of the present invention.

Each graph of FIGS. 12A to 12F shows the process in the panel driver 126 of the display device 100 in time-series, where the left view of FIGS. 12B to 12E shows the signal characteristic of the processing result of the pre-stage such as "signal characteristic of the processing result in FIG. 12A corresponds to the left view of FIG. 12B". The right view of FIGS. 12A to 12E shows the signal characteristics used as a coefficient in the process.

[i] Transition of First Signal Characteristic: Transition by Processing of Linear Conversion Part 144

As shown on the left view of FIG. 12A, the image signal received by the HDMI sink 102 and input to the panel driver 126 has a predetermined gamma value (e.g., "2.2"). The linear conversion part 144 of the panel driver 126 multiplies a gamma curve (linear gamma, right view of FIG. 12A) opposite to the gamma curve (left view of FIG. 12A) represented by the image signal input to the panel driver 126 so as to cancel out the gamma value of the image signal input to the panel driver 126 to correct the image signal having a characteristic in which the relationship between the light quantity of the subject represented by the image signal and the output B is linear.

[ii] Transition of Second Signal Characteristic: Transition by Processing of Gamma Conversion Part 162

The gamma conversion part 162 of the panel driver 126 multiplies a gamma curve (panel gamma, right view of FIG. 12B) opposite to the gamma curve unique to the panel 108 in advance so as to cancel out the VI characteristic of the transistor (right view of FIG. 12D) arranged in the panel 108.

[iii] Transition of Third Signal Characteristic: Transition by D/A Conversion in Data Driver 136

Figure 12C:
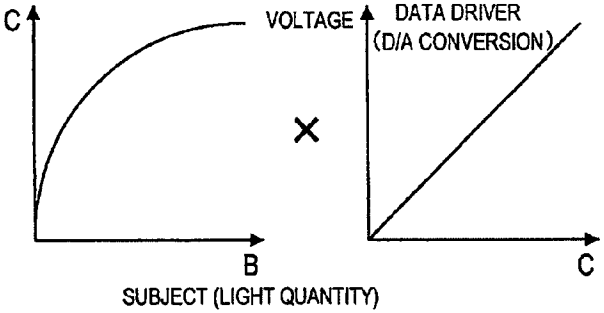
FIG. 12C is an explanatory view showing the outline of transition of the signal characteristic in the display device according to the embodiment of the present invention.

FIG. 12C shows a case where the image signal is D/A converted in the data driver 136. As shown in FIG. 12C, the relationship between the light quantity of the subject represented by the image signal in the image signal and the voltage signal D/A converted from the image signal becomes as shown on the left view of FIG. 12D by D/A converting the image signal in the data driver 136.

[iv] Transition of Fourth Signal Characteristic: Transition in Pixel Circuit of Panel 108

Figure 12D:
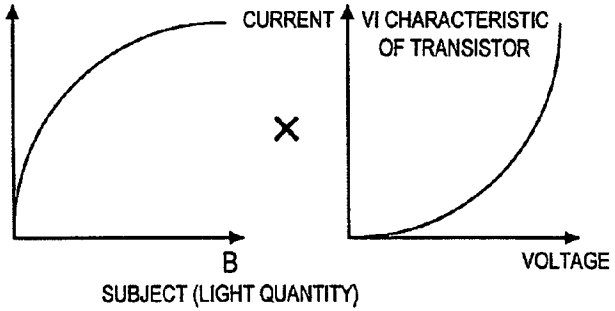
FIG. 12D is an explanatory view showing the outline of transition of the signal characteristic in the display device according to the embodiment of the present invention.

FIG. 12D shows a case where the voltage signal is applied to the pixel circuit arranged in the panel 108 by the data driver 136. As shown in FIG. 12B, the gamma conversion part 162 of the panel driver 126 multiplies in advance the panel gamma corresponding to the VI characteristic of the transistor arranged in the panel 108. Therefore, when the voltage signal is applied to the pixel circuit arranged in the panel 108, the relationship between the light quantity of the subject represented by the image signal in the image signal and the current applied to the pixel circuit becomes linear as shown on the left view of FIG. 12E.

[v] Transition of Fifth Signal Characteristic: Transition in Light Emitting Element (Organic EL Element)

Figure 12E:
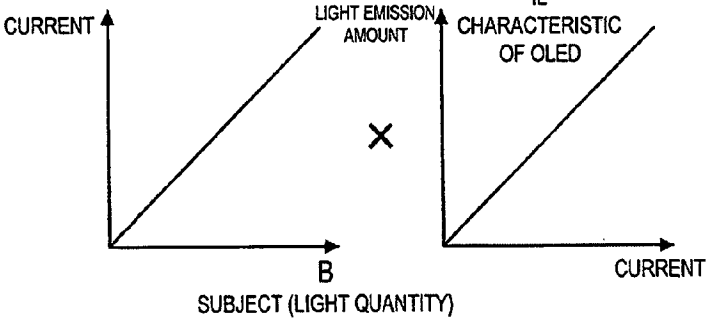
FIG. 12E is an explanatory view showing the outline of transition of the signal characteristic in the display device according to the embodiment of the present invention.
Figure 12F:
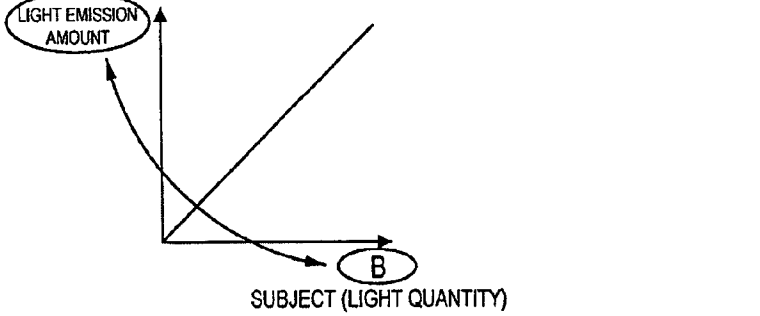
FIG. 12F is an explanatory view showing the outline of transition of the signal characteristic in the display device according to the embodiment of the present invention.

As shown on the right view of FIG. 12E, the IL characteristic of the organic EL element (OLED) becomes linear. Therefore, in the light emitting element of the panel 108, the relationship between the light quantity of the subject represented by the image signal shown in the image signal and the light emission amount light emitted from the light emitting element also has a linear relationship by multiplying those having linear signal characteristics as shown in FIG. 12E (FIG. 12F).

As shown in FIGS. 12A to 12F, the display device 100 can have a linear relationship between the light quantity of the subject represented by the image signal received by the HDMI sink 102 and the light emission amount light emitted from the light emitting element. Therefore, the display device 100 can display an image faithfully following the image signal.

(Control of Light Emission Time and Gain of Image Signal in One Frame Period)

The control of the light emission time (duty) and the gain of the image signal in one frame period according to the embodiment of the present invention will now be described. The control of the light emission time and the gain of the image signal in one frame period according to the embodiment of the present invention can be carried out in the light emission time control part 154 of the panel driver 126.

Figure 13:
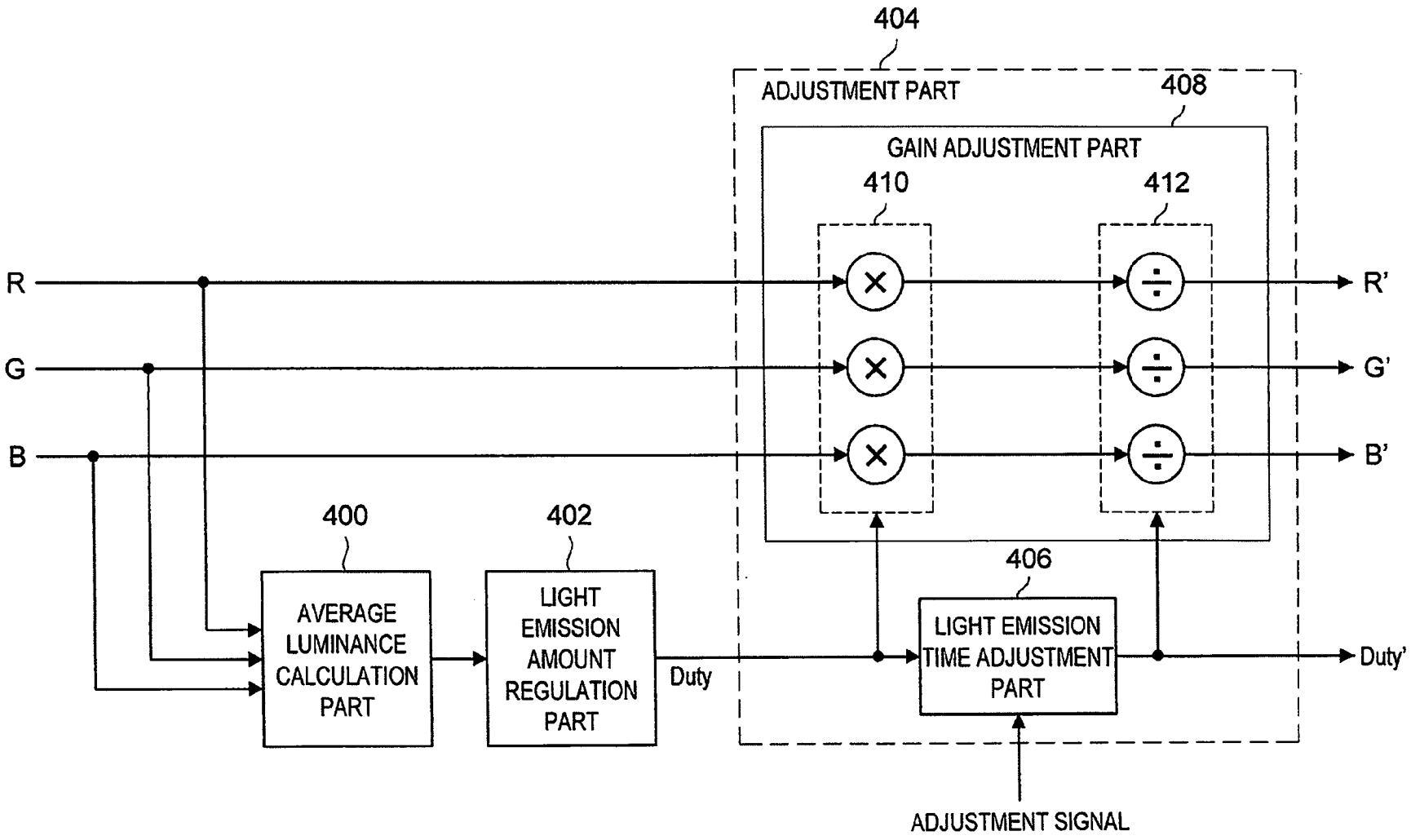
FIG. 13 is a block diagram showing one example of a light emission time control part according to the embodiment of the present invention.

FIG. 13 is a block diagram showing one example of the light emission time control part 154 according to the embodiment of the present invention. The following description will be made assuming the image signal input to the light emission time control part 154 is a signal independent for each color of R, G, and B corresponding to the image of every one frame period (unit time).

With reference to FIG. 13, the light emission time control part 154 includes an average luminance calculation part 400, a light emission amount regulation part 402, and an adjustment part 404.

The average luminance calculation part 400 calculates an average value of the luminance in a predetermined period based on the input image signals of R, G, and B. The predetermined period is one frame period herein, but is not limited thereto, and may be a two-frame period.

The average luminance calculation part 400 can calculate the average value of the luminance for every predetermined period (i.e., calculate the average value of the luminance in a constant cycle), but is not limited thereto, and the predetermined period may be a varying period.

The following description will be made with the predetermined period being one frame period, and the average luminance calculation part 400 calculating the average value of the luminance for every one frame period.

[Configuration of Average Luminance Calculation Part 400]

Figure 14:
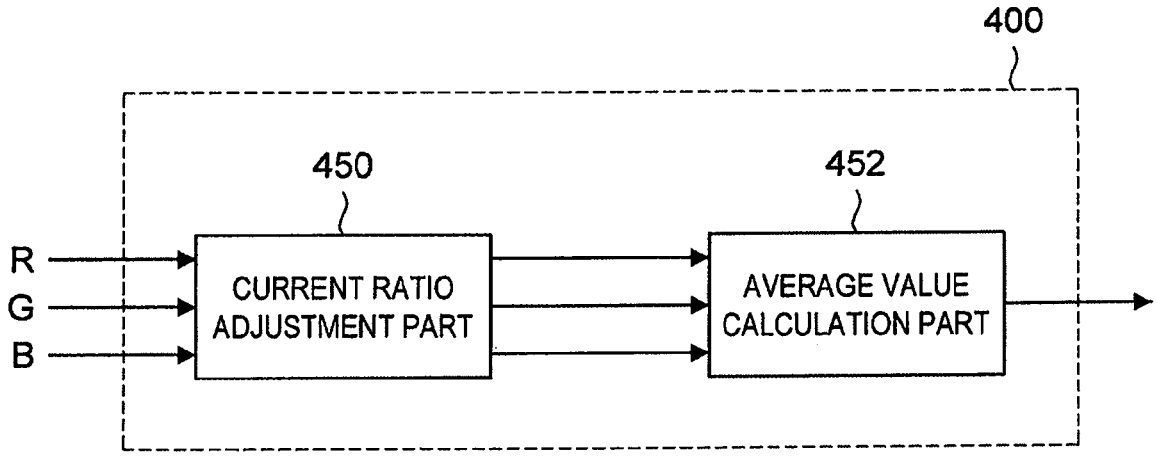
FIG. 14 is a block diagram showing an average luminance calculation part according to the embodiment of the present invention.

FIG. 14 is a block diagram showing the average luminance calculation part 400 according to the embodiment of the present invention. With reference to FIG. 14, the average luminance calculation part 400 includes a current ratio adjustment part 450 and an average value calculation part 452.

The current ratio adjustment part 450 adjusts the current ratio of the input image signals of R, G, and B by multiplying a predetermined correction coefficient for each color with respect to each input image signals of R, G, and B. The predetermined correction coefficient is a value that differs for each color in correspondence to the respective VI ratio (voltage—current ratio) of the light emitting element of R, the light emitting element of G, and the light emitting element of B configuring the pixels of the panel 108.

Figure 15:
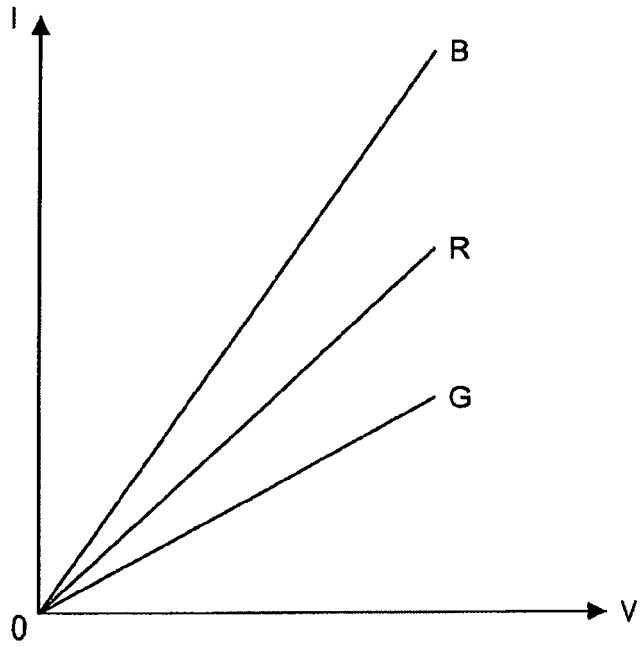
FIG. 15 is an explanatory view showing one example of the VI ratio of the light emitting element of each color configuring the pixel according to the embodiment of the present invention.

FIG. 15 is an explanatory view showing one example of the VI ratio of the light emitting element of each color configuring the pixels according to the embodiment of the present invention. As shown in FIG. 15, the VI ratio of the light emitting element of each color configuring the pixel differs for every color such that "light emitting element of B>light emitting element of R>light emitting element of G". As described above, the display device 100 multiplies the gamma curve opposite to the gamma curve unique to the panel 108 in the gamma conversion part 162 to cancel the gamma value unique to the panel 108 and perform the process in a linear region. Therefore, the respective VI ratio of the light emitting element of R, the light emitting element of G, and the light emitting element of B can be obtained in advance by deriving in advance the relationship of VI as shown in FIG. 15 with the duty fixed at a predetermined value (e.g., "0.25").

The current ratio adjustment part 450 may include a storage member, and the predetermined correction coefficient used by the current ratio adjustment part 450 may be held in the storage member. The storage member of the current ratio adjustment part 450 includes a non-volatile memory such as EEPROM and flash memory, but is not limited thereto. The predetermined correction coefficient used by the current ratio adjustment part 450 may be held in a storage member of the display device 100 such as the recordation part 130 or the storage 132, and appropriately read by the current ratio adjustment part 450.

The average value calculation part 452 calculates an average luminance (APL, average picture level) in one frame period from the image signals of R, G, and B adjusted by the current ratio adjustment part 450. A method of calculating the average luminance in one frame period calculated by the average value calculation part 452 includes using arithmetic average, but is not limited thereto, and the average luminance may be calculated using geometric average or weighted average.

The average luminance calculation part 400 calculates the average luminance in one frame period as described above, and outputs the average luminance.

Again with reference to FIG. 13, the light emission amount regulation part 402 sets a reference duty corresponding to the average luminance in one frame period calculated by the average luminance calculation part 400. The reference duty is a duty that becomes a reference for regulating the light emission amount for light emitting the pixel (light emitting element) in unit time (e.g., one frame period).

The light emission amount in one frame period (unit time) can be represented with the following equation 1. Here, Lum indicates light emission amount, Sig indicates signal level, and Duty indicates light emission time.

$$Lum=(Sig)\times(\text{Duty}) \qquad \text{(Equation 1)}$$

As expressed in equation 1, the light emission amount depends only on the signal level of the input image signal, that is, the gain of the image signal by setting the reference duty.

The setting of the reference duty in the light emission amount regulation part 402 can be performed using a lookup table in which the average luminance in one frame period and the reference duty are associated. The light emission amount regulation part 402 may store the lookup table in a storage member including a non-volatile memory such as EEPROM and flash memory, and a magnetic recording medium such as hard disc.

[Method of Obtaining Value Held in the Lookup Table According to the Embodiment of the Present Invention]

Figure 16:
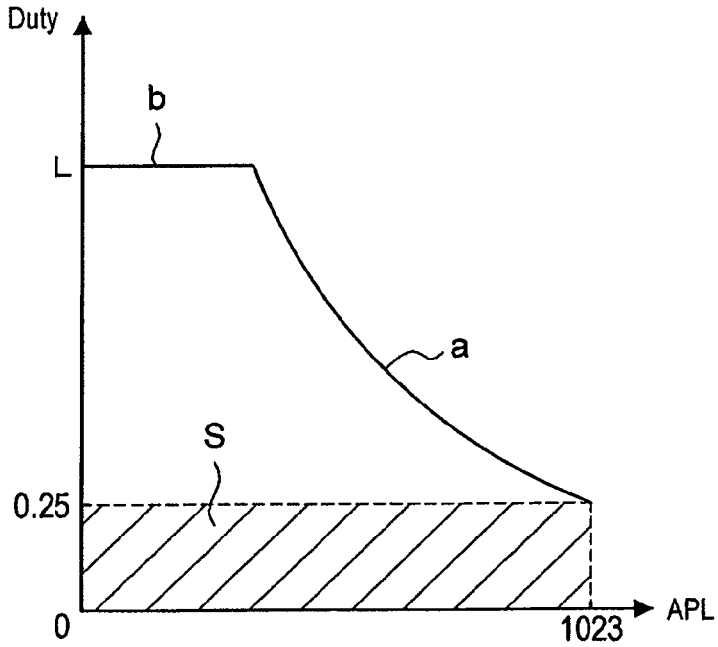
FIG. 16 is an explanatory view describing a method of obtaining the value held in the lookup table according to the embodiment of the present invention.

The method of obtaining the value held in the lookup table according to the embodiment of the present invention will now be described. FIG. 16 is an explanatory view describing a method of obtaining the value held in the lookup table according to the embodiment of the present invention, and shows a relationship of the average luminance (APL) in one frame period and the reference duty (Duty). FIG. shows a case where the average luminance in one frame period is represented with digital data of ten bits by way of example, but it should be noted that the average luminance in one frame period according to the embodiment of the present invention is not limited to digital data of ten bits.

The lookup table according to the embodiment of the present invention is obtained with the light emission amount when the luminance is a maximum (in this case, "white" image is displayed on the panel 108) at a predetermined duty as a reference.

An area S shown in FIG. 16 shows the light emission amount when the luminance is a maximum with 25% set as the predetermined duty. The predetermined duty according to the embodiment of the present invention is not limited to 25%, and can be set in accordance with the characteristics (e.g., characteristics of light emitting element etc.) of the panel 108 arranged in the display device 100, the MTBF (Mean Time Between Failure) of the display device 100, and the like.

A curve a shown in FIG. 16 is a curve that passes a value at which the product of the average luminance (APL) in one frame period and the reference duty (Duty) becomes equal to the area S when the reference duty is greater than 25%.

A line b shown in FIG. 16 is a line that defines an upper limit value L of the reference duty with respect to the curve a. As shown in FIG. 16, an upper limit value can be provided to the reference duty in the lookup table according to the embodiment of the present invention. The reason for providing the upper limit value in the reference duty in the embodiment of the present invention is to solve the issue originating from the trade off relationship of the "luminance" related to the duty and the "movement blur" when the moving image is displayed. The issue originating from the trade off relationship of the "luminance" related to the duty and the "movement blur" includes the following.

<When Duty is Large>

Luminance: higher

Movement blur: larger

<When Duty is Small>

Luminance: lower

Movement blur: smaller

Therefore, in the lookup table according to the embodiment of the present invention, the issue originating from the trade off relationship of the luminance and the movement blur is solved by setting the upper limit value L in the reference duty and obtaining a constant balance between the "luminance" and the "movement blur". The upper limit value L of the reference duty can be set in accordance with the characteristics (e.g., characteristics of the light emitting element, and the like) of the panel 108 arranged in the display device 100.

The light emission amount regulation part 402 can set the reference duty corresponding to the average luminance in one frame period calculated by the average luminance calculation part 400 by using the lookup table in which the average luminance in one frame period and the reference duty are associated so as to take a value on the curve a and the line b shown in FIG. 16. An example where the upper limit value L is set in the reference duty in the light emission amount regulation part 402 as shown in FIG. 16 has been described above by way of example, but the embodiment of the present invention is not limited thereto. For instance, a light emission time adjustment part 406 (to be hereinafter described) of the adjustment part 404 may provide a predetermined upper limit value in the duty.

The light emission time control part 154 will be described with reference again to FIG. 13. The adjustment part 404 includes the light emission time adjustment part 406 and a gain adjustment part 408, and adjusts the reference duty and the gain of the image signal output from the light emission amount regulation part 402.

The light emission time adjustment part 406 adjusts the reference duty output from the light emission amount regulation part 402, and outputs an actual duty for substantially regulating the light emission time for light emitting the respective light emitting element of the panel 108 per unit time. Outputting of the actual duty by adjusting the reference duty in the light emission time adjustment part 406 is referred to as "adjustment of actual duty". An adjustment example of the actual duty in the light emission time adjustment part 406 will be described below.

[I] First Adjustment Example of Actual Duty: Setting of Lower Limit Value

Figure 17:
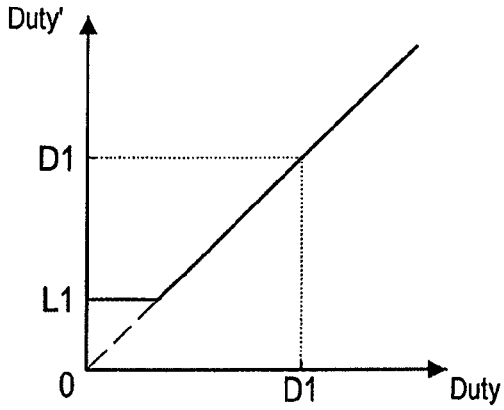
FIG. 17 is an explanatory view describing a first adjustment example of the actual duty in the light emission time adjustment part according to the embodiment of the present invention.

FIG. 17 is an explanatory view describing a first adjustment example of the actual duty in the light emission time adjustment part 406 according to the embodiment of the present invention. FIG. 17 shows a relationship between the reference duty (Duty) output from the light emission amount regulation part 402 and the actual duty (Duty') output from the light emission time adjustment part 406.

With reference to FIG. 17, the reference duty (Duty) output from the light emission amount regulation part 402 and the actual duty (Duty') output from the light emission time adjustment part 406 are basically in a proportionality relation of slope 1, but it can be seen that the lower limit value L1 is provided in the actual duty (Duty').

As described above, a merit in that the "movement blur" becomes smaller is obtained but a demerit in that the "luminance" becomes lower arises when the duty is small. When the duty becomes short to a curtain extent, a demerit in that flickers occur (stand out) arises. The light emission time adjustment part 406 thus outputs the reference duty as the actual duty when the reference duty (Duty) output from the light emission amount regulation part 402 is L1 ]·Duty (within regulated range), and outputs the lower limit value L1 as the actual duty when the reference duty (Duty) is L1>Duty (outside regulated range) by providing the lower limit value L1 to the actual duty (Duty'). The rise in demerits is suppressed and lowering in image quality is prevented by adjusting the actual duty as described above in the light emission time adjustment part 406.

When the light emission time adjustment part 406 adjusts the actual duty as shown in FIG. 17, lowering in image quality of the image to be displayed by the display device 100 can be prevented, and higher image quality can be achieved.

The actual duty can be adjusted by having the light emission time adjustment part 406 store the lower limit value L1 in the storage member (not shown) in advance, and comparing the reference duty output from the light emission amount regulation part 402 and the lower limit value L1, but is not limited thereto. The light emission time adjustment part 406 may include a storage member, and the lower limit value L1 may be held in the storage member. The storage member of the light emission time adjustment part 406 may be a non-volatile memory such as EEPROM and flash memory, but is not limited thereto. The lower limit value L1 used by the light emission time adjustment part 406 may be held in the storage member arranged in the display device 100 such as the recordation part 130 or the storage 132, and appropriately read out by the light emission time adjustment part 406.

The lower limit value L1 can be set to a value at which the flickers do not stand out when a video is displayed on the panel 108, and may be set in accordance with the characteristics of the panel 108 (e.g., characteristics of the light emitting element etc.).

[II] Second Adjustment Example of Actual Duty: Setting of Upper Limit Value

Figure 18:
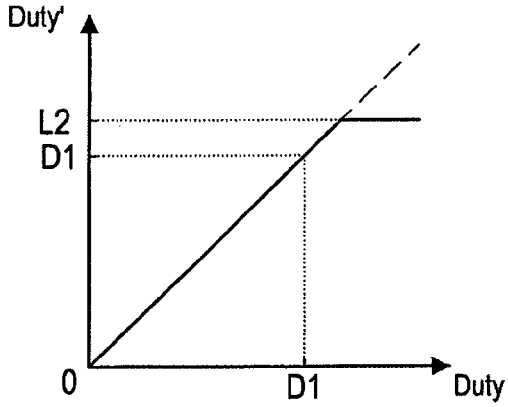
FIG. 18 is an explanatory view describing a second adjustment example of the actual duty in the light emission time adjustment part according to the embodiment of the present invention.

FIG. 18 is an explanatory view describing a second adjustment example of the actual duty in the light emission time adjustment part 406 according to the embodiment of the present invention. Similar to FIG. 17, FIG. 18 shows a relationship between the reference duty (Duty) output from the light emission amount regulation part 402 and the actual duty (Duty') output from the light emission time adjustment part 406.

With reference to FIG. 18, the reference duty (Duty) output from the light emission amount regulation part 402 and the actual duty (Duty') output from the light emission time adjustment part 406 are basically in a proportionality relation of slope 1, but it can be seen that the upper limit value L2 is provided in the actual duty (Duty').

As described above, a merit in that the "luminance" becomes higher is obtained but a demerit in that the "movement blur" becomes larger arises when the duty is large. The light emission time adjustment part 406 thus outputs the reference duty as the actual duty when the reference duty (Duty) output from the light emission amount regulation part 402 is Duty ]·L2 (within regulated range) and outputs the upper limit value L2 as the actual duty when the reference duty (Duty) is Duty>L2 (outside regulated range) by providing the upper limit value L2 to the actual duty (Duty'). The rise in demerits is suppressed and lowering in image quality can be prevented by adjusting the actual duty as described above in the light emission time adjustment part 406.

When the light emission time adjustment part 406 adjusts the actual duty as shown in FIG. 18, lowering in image quality of the image to be displayed by the display device 100 can be prevented, and higher image quality can be achieved.

The actual duty can be adjusted by having the light emission time adjustment part 406 store the upper limit value L2 in the storage member (not shown) in advance, and comparing the reference duty output from the light emission amount regulation part 402 and the upper limit value L2, but is not limited thereto. The light emission time adjustment part 406 clips the value of the reference duty output from the light emission amount regulation part 402, so that the actual duty set with the upper limit value L2 can be output.

The upper limit value L2 can be set to a value at which the movement blurs do not stand out when a video is displayed on the panel 108, and may be set in accordance with the characteristics of the panel 108 (e.g., characteristics of the light emitting element etc.).

Figure 19:
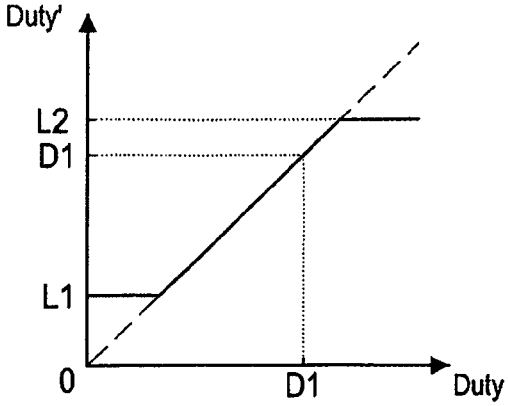
FIG. 19 is an explanatory view describing a third adjustment example of the actual duty in the light emission time adjustment part according to the embodiment of the present invention.

[III] Third Adjustment Example of Actual Duty: Setting of Lower Limit Value/Upper Limit Value Examples of providing the lower limit value L1 or the upper limit value L2 to the actual duty have been described in the first and second adjustment examples of the actual duty. However, the adjustment of the actual duty in the light emission time adjustment part 406 is not limited to the first and second adjustment examples. FIG. 19 is an explanatory view describing a third adjustment example of the actual duty in the light emission time adjustment part 406 according to the embodiment of the present invention. Similar to FIG. 17, FIG. 19 shows a relationship between the reference duty (Duty) output from the light emission amount regulation part 402 and the actual duty (Duty') output from the light emission time adjustment part 406.

With reference to FIG. 19, the reference duty (Duty) output from the light emission amount regulation part 402 and the actual duty (Duty') output from the light emission time adjustment part 406 are basically in a proportionality relation of slope 1, but it can be seen that the lower limit value L1 and the upper limit value L2 are provided in the actual duty (Duty'). That is, the light emission time adjustment part 406 outputs the reference duty as the actual duty when the reference duty (Duty) output from the light emission amount regulation part 402 is L1 ]·Duty ]·L2 (within regulated range). The light emission time adjustment part 406 outputs the lower limit value L1 when L1>Duty (outside regulated range), and outputs the upper limit value L2 as the actual duty when the reference duty (Duty) is Duty>L2 (outside regulated range).

The light emission time adjustment part 406 suppresses the demerits (demerits mentioned in the first and second adjustment examples) originating from the trade off relationship of the luminance and the movement blur, and prevents lowering in image quality by providing the lower limit value L1 and the upper limit value L2 to the actual duty (Duty'). When the light emission time adjustment part 406 adjusts the actual duty as shown in FIG. 19, lowering in image quality of the image to be displayed by the display device 100 can be prevented, and higher image quality can be achieved.

Figure 20:
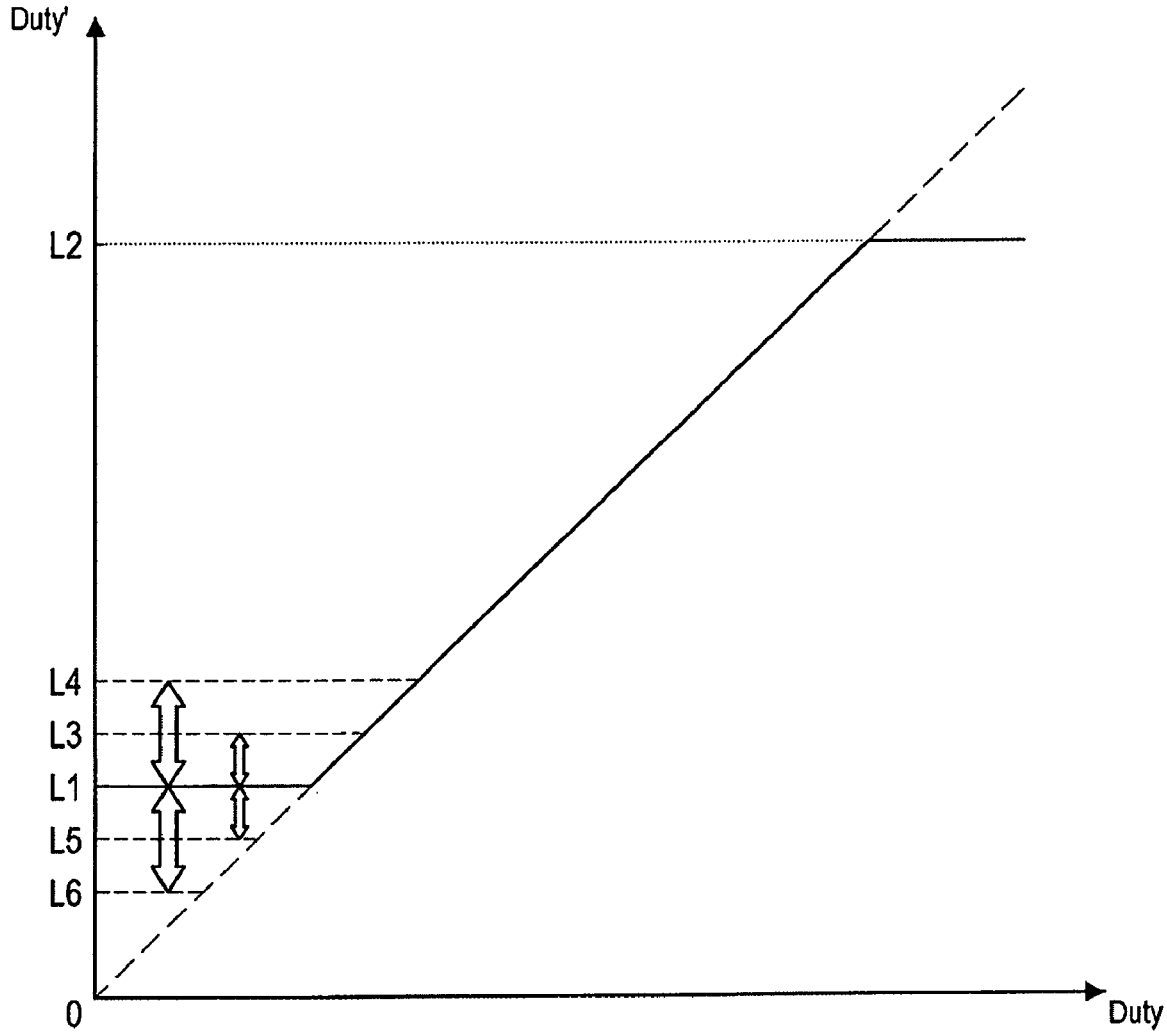
FIG. 20 is an explanatory view describing a fourth adjustment example of the actual duty in the light emission time adjustment part according to the embodiment of the present invention.

[IV] Fourth Adjustment Example of Actual Duty: Setting of Lower Limit Value Based on Adjustment Signal A configuration of providing the predetermined lower limit value L1 and/or the predetermined upper limit value L2 to the actual duty has been shown in the first to third adjustment examples of the actual duty described above. However, the adjustment of the actual duty in the light emission time adjustment part 406 is not limited to the first to third adjustment examples, and the value of the lower limit value can be changed according to the adjustment signal transmitted from the control part 104. FIG. 20 is an explanatory view describing a fourth adjustment example of the actual duty in the light emission time adjustment part 406 according to the embodiment of the present invention. Similar to FIG. 17, FIG. 20 shows a relationship between the reference duty (Duty) output from the light emission amount regulation part 402 and the actual duty (Duty') output from the light emission time adjustment part 406.

With reference to FIG. 20, the reference duty (Duty) output from the light emission amount regulation part 402 and the actual duty (Duty') output from the light emission time adjustment part 406 are basically in a proportionality relation of slope 1, but it can be seen that the lower limit value L1 and the upper limit value L2 are provided in the actual duty (Duty'), similar to the third adjustment example shown in FIG. 19.

In FIG. 20, a lower limit value L3 and a lower limit value L4 with larger actual duty (Duty') than the lower limit value L1, and a lower limit value L5 and a lower limit value L6 with smaller actual duty (Duty') than the lower limit value L1 are further set as the lower limit values.

In the fourth adjustment example, the light emission time adjustment part 406 sets the lower limit value corresponding to the adjustment signal shown in (i) to (v) below based on the adjustment signal transmitted from the control part 104.

(i) When "Text" Content Adjustment Signal is Transmitted

For example, when the "text" content adjustment signal is transmitted from the control part 104, the light emission time adjustment part 406 sets the lower limit value L3 to the actual duty (Duty'). The lower limit value L3 corresponds to the predetermined first value. The light emission time adjustment part 406 outputs the reference duty as the actual duty when the reference duty (Duty) output from the light emission amount regulation part 402 is L3 ]·Duty ]·L2 (within regulated range). The light emission time adjustment part 406 outputs the lower limit value L3 as the actual duty when L3>Duty (outside regulated range), and outputs the upper limit value L2 when Duty>L2 (outside regulated range).

(ii) When "Photograph" Content Adjustment Signal is Transmitted

For example, when the "text" content adjustment signal is transmitted from the control part 104, the light emission time adjustment part 406 sets the lower limit value L4 to the actual duty (Duty'). The lower limit value L4 corresponds to the predetermined second value. The light emission time adjustment part 406 outputs the reference duty as the actual duty when the reference duty (Duty) output from the light emission amount regulation part 402 is L4 ]·Duty ]·L2 (within regulated range). The light emission time adjustment part 406 outputs the lower limit value L4 as the actual duty when L4>Duty (outside regulated range), and outputs the upper limit value L2 when Duty>L2 (outside regulated range).

(iii) When "Cinema" Content Adjustment Signal is Transmitted

For example, when the "cinema" content adjustment signal is transmitted from the control part 104, the light emission time adjustment part 406 sets the lower limit value L5 to the actual duty (Duty'). The lower limit value L5 corresponds to the predetermined third value. The light emission time adjustment part 406 outputs the reference duty as the actual duty when the reference duty (Duty) output from the light emission amount regulation part 402 is L5 ]·Duty ]·L2 (within regulated range). The light emission time adjustment part 406 outputs the lower limit value L5 as the actual duty when L5>Duty (outside regulated range), and outputs the upper limit value L2 when Duty>L2 (outside regulated range).

(iv) When "Game" Content Adjustment Signal is Transmitted

For example, when the "game" content adjustment signal is transmitted from the control part 104, the light emission time adjustment part 406 sets the lower limit value L5 to the actual duty (Duty'). The lower limit value L6 corresponds to the predetermined fourth value. The light emission time adjustment part 406 outputs the reference duty as the actual duty when the reference duty (Duty) output from the light emission amount regulation part 402 is L6 ]·Duty ]·L2 (within regulated range). The light emission time adjustment part 406 outputs the lower limit value L6 as the actual duty when L6>Duty (outside regulated range), and outputs the upper limit value L2 when Duty>L2 (outside regulated range).

(v) When Standard Adjustment Signal is Transmitted

For example, when the standard adjustment signal shown in FIG. 10 is transmitted from the control part 104, the light emission time adjustment part 406 sets the lower limit value L1 to the actual duty (Duty'). The lower limit value L1 corresponds to the standard set value. The light emission time adjustment part 406 outputs the reference duty as the actual duty when the reference duty (Duty) output from the light emission amount regulation part 402 is L1 ]·Duty ]·L2 (within regulated range). The light emission time adjustment part 406 outputs the lower limit value L1 as the actual duty when L1>Duty (outside regulated range), and outputs the upper limit value L2 when Duty>L2 (outside regulated range).

The light emission time adjustment part 406 suppresses demerits originating from the trade off relationship of the luminance and the movement blur and prevents lowering in image quality by providing the lower limit values L1 to L6 and the upper limit value L2 to the actual duty (Duty'). The light emission time adjustment part 406 appropriately changes the lower limit value of the actual duty (Duty') according to the adjustment signal transmitted from the control part 104 to adjust the duty according to the content of the content of the image represented by the image signal received by the HDMI sink 102. Therefore, the light emission time adjustment part 406 adjusts the actual duty as shown in FIG. 20 to prevent lowering in image quality of the image to be displayed by the display device 100, and achieve higher image quality.

The control part 104 can generate the adjustment signal and the control signal corresponding to the information of the content represented by the content identification information when the information of the content represented by the content identification information represents the same content continuously over a predetermined number of times. Therefore, the display device 100 can suppress the setting frequency of the lower limit value of the actual duty set according to the adjustment signal in the light emission time adjustment part 406 and prevent lowering in image quality caused by the change in lower limit value of the actual duty over plural times in one second.

A configuration in which the lower limit value and the upper limit value are provided to the actual duty (Duty') (i.e., configuration corresponding to third adjustment example) is described as the fourth adjustment example, but the adjustment of the actual duty according to the embodiment of the present invention is not limited to the above. For instance, the adjustment of the actual duty according to the embodiment of the present invention can appropriately change the lower limit value of the first adjustment example shown in FIG. 17 according to the adjustment signal transmitted from the control part 104.

An example where one of the "text" content adjustment signal, the "photograph" content adjustment signal, the "cinema" content adjustment signal, the "game" content adjustment signal, or the standard adjustment signal is transmitted from the control part 104 has been described as the fourth adjustment example, but the adjustment signal according to the embodiment of the present invention is not limited thereto. When the adjustment signal transmitted from the control part 104 differs from the above, the lower limit value of the number corresponding to the number of adjustment signals to be transmitted is set. Furthermore, an example of appropriately changing the lower limit value of the actual duty (Duty') based on the adjustment signal transmitted from the control part 104 has been described as a fourth adjustment example, but is not limited thereto, and the upper limit value of the actual duty (Duty') may be changed based on the adjustment signal.

As shown in first to fourth adjustment examples of the actual duty, the light emission time adjustment part 406 provides the lower limit value and/or the upper limit value to the actual duty to be output and adjusts the actual duty to prevent lowering in image quality of the image to be displayed by the display device 100 and achieve higher image quality. The lower limit values L1 to L6 and the upper limit value L2 of the actual duty shown in FIGS. 17 to 20 can be set in advance according to the characteristic (e.g., characteristic of light emitting element etc.) of the panel 108 arranged in the display device 100, but is not limited thereto. For instance, the lower limit values L1 to L6 and the upper limit value L2 of the actual duty may be changed according to the user input from the operation part (not shown).

With reference again to FIG. 13, the light emission time control part 154 will be described. A gain adjustment part 408 includes a first gain correction portion 410 and a second gain correction portion 412. The gain adjustment part 408 adjusts the gain of the input image signals of R, G, and B in correspondence to the adjustment of the actual duty in the light emission time adjustment part 406. As expressed with equation 1, the light emission amount can be expressed by a product of the signal level and the light emission time. The gain adjustment part 408 adjusts the gain of the image signal so that the light emission amount defined by the reference duty and the gain of the image signal is maintained the same even after the adjustment of the actual duty.

The first gain correction portion 410 multiplies the reference duty output from the light emission amount regulation part 401 with respect to each input image signals of R, G, and B.

The second gain correction portion 412 divides each R, G, and B image signals corrected by the first gain correction portion 410 with the actual duty (Duty') output from the light emission time adjustment part 406.

As a result of the correction in the first gain correction portion 410 and the second gain correction portion 412, the adjusted R image signal (R'), the adjusted G image signal (G') and the adjusted B image signal (B') output from the gain adjustment part 408 can be expressed with the following equations 2 to 4.

$$R'=\{(R)\times\text{™}(\text{Duty})\}/(\text{Duty}')$$

$$R'=(R)\times\cdot\{(\text{Duty})/(\text{Duty}')\} \quad \text{(Equation 2)}$$

$$G'=\{(G)\times\cdot(\text{Duty})\}/(\text{Duty}')$$

$$G'=(G)\times\cdot\{(\text{Duty})/(\text{Duty}')\} \quad \text{(Equation 3)}$$

$$B'=\{(B)\times\cdot(\text{Duty})\}/(\text{Duty}')$$

$$B'=(B)\times\cdot\{(\text{Duty})/(\text{Duty}')\} \quad \text{(Equation 4)}$$

It is apparent with reference to equations 2 to 4 that the image signals (R', G', B') output from the gain adjustment part 408 correspond to the adjustment ratio ((Duty)/(Duty')) of the duty in the light emission time adjustment part 406.

The relationship between the adjustment ratio of the duty in the light emission time adjustment part 406, and the adjustment of the gain of the image signal in the gain adjustment part 408 can be expressed as (1) to (3) below.

(1) When adjustment ratio of duty=1

The image signals (R', G', B') output from the gain adjustment part 408=input image signals (R, G, B): no change in gain of image signal (2) When adjustment ratio of duty<1 (when actual duty is set to lower limit values L1 to L6)

The image signals (R', G', B') output from the gain adjustment part 408<input image signals (R, G, B): attenuation in gain of image signal (3) When adjustment ratio of duty>1 (when actual duty is set to upper limit value L2)

The image signals (R', G', B') output from the gain adjustment part 408>input image signals (R, G, B): amplification in gain of image signal As expressed with equations 1, and 2 to 4, the light emission amount in one frame period (unit time) defined by the actual duty (Duty') and the image signals (R', G', B') output from the adjustment part 404 does not change at before and after the adjustment in the adjustment part 404. Therefore, the adjustment part 404 can adjust the actual duty and the gain of the image signals while maintaining the same light emission amount.

As described above, the display device 100 according to the embodiment of the present invention calculates the average luminance from the R, G, and B image signals input in one frame period (unit time: predetermined period), and sets the reference duty corresponding to the calculated average luminance. The reference duty according to the embodiment of the present invention is set to a value the largest light emission amount in the predetermined duty and the light emission amount defined by the reference duty and the average luminance in one frame period (unit time: predetermined period) become the same. The display device 100 can adjust the actual duty and the gain of the image signal so that the light emission amount defined by the reference duty and the gain of the image signal is maintained the same. Therefore, in the display device 100, the light emission amount in one frame period (unit time) will not be larger than the largest light emission amount in the predetermined duty, and thus the display device 100 can prevent overcurrent from flowing to each pixel (more precisely, light emitting element of each pixel) of the panel 108.

The display device 100 adjusts the actual duty by providing the lower limit value L1 and/or the upper limit value L2 to the actual duty to suppress the rise in demerits (demerits explained in the first and second adjustment examples) originating from the trade off relationship of the luminance and the movement blur and prevent lowering in image quality. Therefore, the display device 100 can achieve higher image quality of the image to be displayed on the panel 108.

The display device 100 generates the adjustment signal and the control signal based on the content information received by the HDMI sink 102, and transmits the generated adjustment signal and the control signal to each part of the signal processing part 106 for processing the image signal received by the HDMI sink 102. The display device 100 can appropriately change the lower limit value of the actual duty (Duty') according to the adjustment signal by inputting the adjustment signal based on the content information to the panel driver 126 of the signal processing part 106. As the control signal based on the content information is transmitted to the chroma decoder 120, the DRC part 122, and the enhancer 124 of the signal processing part 106, the display device 100 can perform processing of the image signal corresponding to the content of the content of the image represented by the input image signal (image signal received by the HDMI sink 102). Therefore, the display device 100 can adjust the duty and process the image signal according to the content of the content of the image represented by the input image signal, thereby preventing lowering in image quality of the image to be displayed on the panel 108 and achieving higher image quality.

Furthermore, the display device 100 generates the adjustment signal and the control signal based on the content information received by the HDMI sink 102, and thus information representing a moving image or a still image is not detected based on the image represented by the image signal as in the display device of the related art. Therefore, the display device 100 can lower the possibility of occurrence of mistaken detection and delay in processing compared to the display device of the related art, and can achieve higher image quality than the display device of the related art.

[Variant of Display Device 100 According to the Embodiment of the Present Invention]

[a] First Variant

As shown in FIG. 13, the light emission time control part 154 includes the average luminance calculation part 400 and the light emission amount regulation part 402, and can set the reference duty based on the average luminance calculated in the average luminance calculation part 400. However, the light emission time control part according to the embodiment of the present invention is not limited to such configuration. The light emission time control part according to the embodiment of the present invention may include a histogram calculation part for calculating the histogram value of the video as a component replacing the average luminance calculation part 400, and the light emission amount regulation part may set the reference duty based on the histogram value. In this configuration as well, the light emission amount in one frame period (unit time) will not be larger than the largest light emission amount in the predetermined duty in the display device according to the first variant, and thus the display device according to the first variant can prevent overcurrent from flowing to each pixel (more precisely, light emitting element of each pixel) of the panel 108. The display device according to the first variant can have effects similar to the display device 100 in addition to the effect of preventing overcurrent.

[b] Second Variant

In the display device 100 shown in FIG. 13, a configuration in which the adjustment signal is transmitted to the light emission time adjustment part 406 of the light emission time control part 154, and the lower limit value of the actual duty (Duty') is appropriately changed according to the adjustment signal has been described, but the display device according to the embodiment of the present invention is not limited thereto. For instance, the display device according to the embodiment of the present invention may have the adjustment signal transmitted to the light emission amount regulation part 402 of the light emission time control part 154, and the upper limit value of the reference duty (Duty) shown in FIG. 16 may be appropriately changed according to the adjustment signal. The display device according to the second variant controls the light emission time per unit time to prevent overcurrent from flowing to the light emitting element and can change the image quality according to the content of the content of the image represented by the image signal by changing the upper limit value of the reference duty (Duty) according to the adjustment signal.

[c] Third Variant

The display device according to the embodiment of the present invention may arbitrarily combine the configuration of the display device 100, the display device according to the first variant, and the display device according to the second variant.

The image reproducing devices 200, 300, . . . have been described by way of example as components configuring the image display system according to the embodiment of the present invention, but the embodiment of the present invention is not limited thereto. For instance, the embodiment of the present invention may be applied to computers such as PC (Personal Computer), disc reproduction devices such as Blu-Ray disc reproduction device (or Blu-Ray recorder) and DVD recorder, game machines such as Play station (registered trademark), and the like.

The display device 100 has been described by way of example as a component configuring the image display system according to the embodiment of the present invention, but the embodiment of the present invention is not limited to such mode. For instance, the embodiment of the present invention may be applied to television receivers for receiving television broadcast and displaying pictures, computers such as PC having a display member on the exterior or the interior thereof, and the like.

(Program According to Embodiment of the Present Invention)

According to a program for causing a computer to function as the display device 100 according to the embodiment of the present invention, higher image quality can be achieved by controlling the light emission time for the light emitting element to emit light per unit time according to the type of content of the input image signal, and also controlling the gain of the image signal.

(Image Signal Processing Method According to the Embodiment of the Present Invention)

Figure 21:
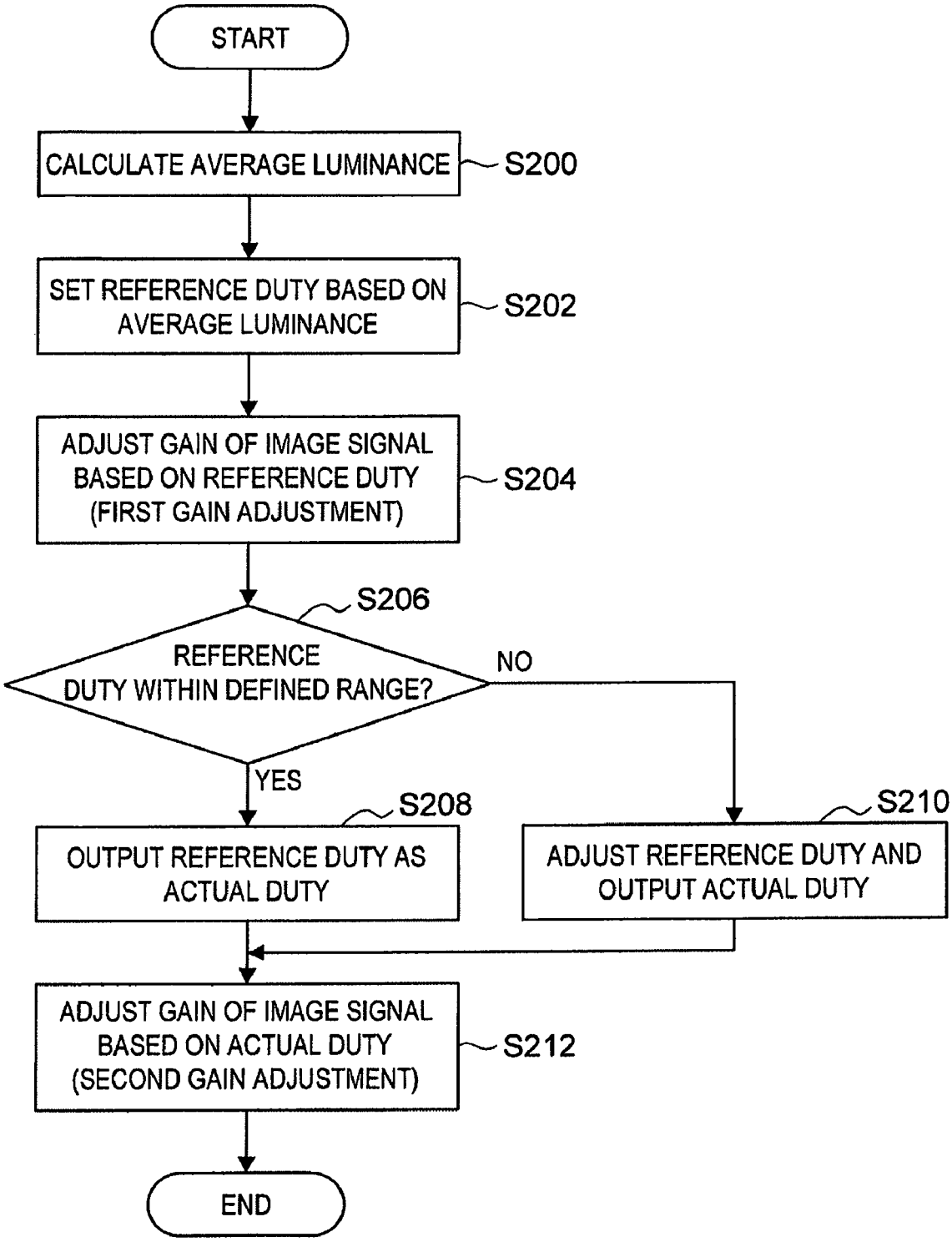
FIG. 21 is a flowchart showing one example of an image signal processing method according to the embodiment of the present invention.

The image signal processing method according to the present invention will now be described. FIG. 21 is a flowchart showing one example of the image signal processing method according to the embodiment of the present invention, and shows one example of a method related to the control of the light emission time per unit time in the display device 100. The following description is made with unit time as one frame period, and the image signals to be input as independent signals for each color of R, G, and B corresponding to the image for every one frame period (unit time).

The display device 100 calculates the average luminance of the image signal in a predetermined period from the input image signals of R, G, and B (S200). The method of calculating the average luminance in step S200 includes arithmetic average, but is not limited thereto. The predetermined period can be assumed as one frame period.

The display device 100 sets the reference duty based on the average luminance calculated in step S200 (S202). The setting of the reference duty in step S202 can be carried out using a lookup table in which the average luminance and the reference duty are associated, for example. The lookup table holds the reference duty such that the largest light emission amount in the predetermined duty and the light emission amount defined by the reference duty and the average luminance become the same. The upper limit value may be provided to the reference duty in the lookup table.

The display device 100 adjusts the gain of the respective input image signals of R, G, and B based on the reference duty set in step S202 (S204; first gain adjustment). The adjustment of the gain in step S204 can be carried out by multiplying the respective input image signals of R, G, and B and the reference duty set in step S202.

The display device 100 then determines whether or not the reference duty set in step S202 is within a defined range (S206). In step S206, determination is made as within the defined range in one of the following (A) to (E) cases.

(A) When reference duty is larger than the predetermined lower limit value (correspond to first adjustment method)

(B) When reference duty is smaller than the predetermined upper limit value (correspond to second adjustment method)

(C) When reference duty is greater than or equal to the predetermined lower limit value and lower than or equal to the predetermined upper limit value (correspond to third adjustment method)

(D) When reference duty is greater than or equal to the lower limit value appropriately changed according to the adjustment signal and lower than or equal to the predetermined upper limit value (correspond to fourth adjustment method)

(E) When reference duty is larger than the lower limit value appropriately changed according to the adjustment signal (correspond to variant of fourth adjustment method)

The adjustment signals represented in (D) and (E) are generated by the control part 104 using the signal generating method shown in FIG. 10. The adjustment signals generated by the control part 104 are transmitted to the light emission time adjustment part 406 of the light emission time control part 154, so that the light emission time adjustment part 406 can appropriately set the lower limit value corresponding to the adjustment signal.

When determined that the reference duty is within the defined range in step S206, the display device 100 outputs the reference duty set in step S202 as the actual duty (S208).

When determined that the reference duty is not within the defined range in step S206, the display device 100 adjusts (adjustment of actual duty) the reference duty set in step S202, and outputs the actual duty (S210). The adjustment of the actual duty in step S210 can be carried out as below (a) to (c) in each cases of (A) to (E).

(a) In the cases of (A) and (E): output lower limit value as actual duty (b) In the case of (B): output upper limit value as actual duty (c) In the cases of (C) and (D): output lower limit value or upper limit value as actual duty The display device 100 adjusts the gain of the image signal adjusted in step S204 based on the actual duty output in step S208 or step S210 (S212: second gain adjustment). The adjustment of the gain of the image signal in step S212 can be carried out according to the adjustment ratio of the actual duty with respect to the reference duty, as expressed in equations 2 to 4. Therefore, three types of adjustment of "attenuate", "amplify", or "no change" can be performed on the gain of the image signal in step S212.

As expressed in equations 1 and 2 to 4, the light emission amount defined by the actual duty output in step S208 or step S210 and the gain of the image signal adjusted in step S212 becomes the same as the light emission amount before adjustment.

The display device 100 can output the reference duty according to the average luminance in one frame period (unit time) of the input image signals by using the image signal processing method shown in FIG. 21. The reference duty is set to a value the largest light emission amount in the predetermined duty and the light emission amount defined by the reference duty and the average luminance in one frame period (unit time: predetermined period) become the same.

The display device 100 can suppress rise in demerits (demerits described in first and second adjustment examples described above) originating from the trade off relationship of the luminance and the movement blur and prevent lowering in image quality by providing the lower limit value and/or upper limit value to the actual duty and adjusting the actual duty using the image signal processing method shown in FIG. 21. Furthermore, since the display device 100 can change the lower limit value of the actual duty according to the adjustment signal generated based on the content identification information, the display device 100 can control the actual duty according to the content of the content of the image represented by the input image signal.

Moreover, the display device 100 can adjust the actual duty and the gain of the image signal so that the light emission amount defined by the reference duty and the gain of the image signal is maintained the same by using the image signal processing method shown in FIG. 21.

Therefore, the display device 100 can achieve higher image quality by controlling the light emission time for the light emitting element to emit light per unit time according to the type of content of the input image signal and also controlling the gain of the image signal using the image signal processing method shown in FIG. 21.

It should be understood by those skilled in the art that various modifications, combinations, sub-combinations and alterations may occur depending on design requirements and other factors insofar as they are within the scope of the appended claims or the equivalents thereof.

For instance, in the display device 100 according to the embodiment of the present invention shown in FIG. 9, a configuration in which the display device 100 includes the HDMI sink 102, and the image signal and control data such as content identification information are received using HDMI has been described, but the embodiment of the present invention is not limited to such configuration. In place of the HDMI, the display device according to the embodiment of the present invention may include a receiving member of the image signal such as D terminal and component terminal, and a separate control data receiving member for receiving the control data such as content identification information. In such configuration as well, the display device according to the embodiment of the present invention can generate adjustment signals based on the content identification information, and thus can have effects similar to the display device 100 described above.

The above-described configuration shows one example of the embodiment of the present invention, and obviously falls within the technical scope of the present invention.

What is claimed is:

1. A display device equipped with a display unit in which light emitting elements which self-emits light according to current amount are arranged in a matrix form, the display device comprising:

a receiving part for receiving a difference signal of a plurality of channels including an image signal and content identification information for defining a type of content inserted in a blanking period of at least one channel, and outputting the image signal and the content identification information;

a light emission amount regulation part for setting a reference duty for defining a light emission amount per unit time in the respective light emitting element according to image information of the image signal;

an adjustment part for adjusting so that an actual duty defining a light emission time for light emitting the light emitting element per unit time is within a predetermined range based on the reference duty and an adjustment signal, and adjusting a gain of the image signal so that a light emission amount defined by the actual duty and the gain of the image signal becomes the same as the light emission amount defined by the reference duty; and an adjustment signal generation part for generating the adjustment signal for setting a lower limit value of the actual duty based on the content identification information.

2. The display device according to claim 1, wherein the adjustment part includes:

a light emission time adjustment part for setting a lower limit value according to the adjustment signal, and adjusting the reference duty to the set lower limit value or an upper limit value defined in advance to output as the actual duty when the reference duty set by the light emission amount regulation part is outside the predetermined range; and a gain adjustment part for adjusting the gain of the image signal based on the reference duty set by the light emission amount regulation part and the actual duty output from the light emission time adjustment part.

3. The display device according to claim 2, wherein the gain adjustment part attenuates the gain of the image signal according to an increase ratio of the actual duty with respect to the reference duty when the light emission time adjustment part outputs the actual duty adjusted to the lower limit value.

4. The display device according to claim 2, wherein the gain adjustment part amplifies the gain of the image signal according to a decrease ratio of the actual duty with respect to the reference duty when the light emission time adjustment part outputs the actual duty adjusted to the upper limit value.

5. The display device according to claim 2, wherein the gain adjustment part includes:

a first gain correction portion for multiplying the input image signal and the reference duty; and a second gain correction portion for dividing the corrected image signal output from the first gain correction portion with the actual duty output from the light emission time adjustment part.

6. The display device according to claim 1, wherein the adjustment signal generation part generates the adjustment signal according to information of the content represented by the content identification information when the information of the content represented by the content identification information represents the same content continuously for a predetermined number of times.

7. The display device according to claim 1, further comprising an average luminance calculation part for calculating an average of luminance in a predetermined period of the image signals; wherein the light emission amount regulation part sets the reference duty according to the average luminance calculated in the average luminance calculation part.

8. The display device according to claim 7, wherein the light emission amount regulation part stores a lookup table in which the luminance of the image signal and the reference duty are corresponded, and uniquely sets the reference duty according to the average luminance calculated in the average luminance calculation part.

9. The display device according to claim 7, wherein the predetermined period for the average luminance calculation part to calculate the average of the luminance is one frame.

10. The display device according to claim 7, wherein the average luminance calculation part includes:

a current ratio adjustment part for multiplying a correction value for every primary color signal based on a voltage—current characteristic for the every primary signal of the image signal, and an average value calculation part for calculating the average of the luminance in the predetermined period of the image signal output from the current ratio adjustment part.

11. The display device according to claim 1, further comprising a linear conversion part for gamma correcting the image signal to correct to a linear image signal; wherein the image signal to be input to the light emission amount regulation part is the corrected image signal.

12. The display device according to claim 1, further comprising a gamma conversion part for performing gamma correction corresponding to a gamma characteristic of the display unit on the image signal.

13. An image signal processing method in a display device equipped with a receiving part for receiving a difference signal of a plurality of channels including an image signal and content identification information for defining a type of content inserted in a blanking period of at least one channel and outputting the image signal and the content identification information, and a display unit in which light emitting elements which self-emits light according to current amount are arranged in a matrix form, the image signal processing method comprising the steps of:

generating an adjustment signal for setting a lower limit of an actual duty defining a light emission time for light emitting the light emitting element per unit time based on the content identification information;

setting a lower limit value of the actual duty according to the adjustment signal generated in the generating step;

setting a reference duty for defining a light emission amount per unit time in the respective light emitting element according to image information of the image signal; and adjusting so that the actual duty is within a predetermined range based on the reference duty and the lower limit value set in the setting step, and adjusting a gain of the image signal so that a light emission amount defined by the actual duty and the gain of the image signal becomes the same as the light emission amount defined by the reference duty.

14. A non-transitory computer readable medium for storing a program used in a display device equipped with a receiving part for receiving a difference signal of a plurality of channels including an image signal and content identification information for defining a type of content inserted in a blanking period of at least one channel and outputting the image signal and the content identification information, and a display unit in which light emitting elements which self-emits light according to current amount are arranged in a matrix form, the program causing a computer to execute the steps of:

generating an adjustment signal for setting a lower limit of an actual duty defining a light emission time for light emitting the light emitting element per unit time based on the content identification information;

setting a lower limit value of the actual duty according to the adjustment signal generated in the generating step;

setting a reference duty for defining a light emission amount per unit time in the respective light emitting element according to image information of the image signal; and adjusting so that the actual duty is within a predetermined range based on the reference duty and the lower limit value set in the setting step, and adjusting a gain of the image signal so that a light emission amount defined by the actual duty and the gain of the image signal becomes the same as the light emission amount defined by the reference duty.

* * * * *